US006869026B2

(12) United States Patent
McKenzie et al.

(10) Patent No.: US 6,869,026 B2
(45) Date of Patent: Mar. 22, 2005

(54) ROTARY SPRINKLER WITH ARC ADJUSTMENT GUIDE AND FLOW-THROUGH SHAFT

(75) Inventors: Jeff McKenzie, Riverside, CA (US); Chad Philip McCormick, West Covina, CA (US); Peter Janku, Temecula, CA (US)

(73) Assignee: The Toro Company, Bloomington, MN (US)

( * ) Notice: Subject to any disclaimer, the term of this patent is extended or adjusted under 35 U.S.C. 154(b) by 92 days.

(21) Appl. No.: 10/455,868

(22) Filed: Jun. 5, 2003

(65) Prior Publication Data

US 2004/0050958 A1 Mar. 18, 2004

Related U.S. Application Data

(63) Continuation of application No. 10/014,916, filed on Oct. 22, 2001.

(60) Provisional application No. 60/386,520, filed on Jun. 5, 2002, and provisional application No. 60/243,538, filed on Oct. 26, 2000.

(51) Int. Cl.[7] ..... B05B 3/04

(52) U.S. Cl. ..... 239/237; 239/71; 239/240; 239/241; 239/206; 239/570; 239/580; 239/590.5

(58) Field of Search ..... 239/71, 73, 203–206, 239/237, 240, 241, 242, 569, 570, 571, 580, 590, 590.5

(56) References Cited

U.S. PATENT DOCUMENTS 3,323,725 A * 6/1967 Hruby, Jr. ..... 239/580
5,335,857 A * 8/1994 Hagon ..... 239/570
6,000,632 A * 12/1999 Wallace ..... 239/204
6,186,413 B1 * 2/2001 Lawson ..... 239/237
6,651,905 B2 * 11/2003 Sesser et al. ..... 239/580
6,732,946 B2 * 5/2004 Veazie ..... 239/71

* cited by examiner

*Primary Examiner*—Steven J. Ganey
(74) *Attorney, Agent, or Firm*—Inskeep Intellectual Property Group, Inc.

(57) ABSTRACT

A rotary sprinkler having an adjustable arc segment whose angular extent and absolute direction relative to the ground are represented by an arc indicator, which arc indicator may comprise a band whose visible length represents the angular extent and whose position on the sprinkler points to the direction. The sprinkler may have the arc segment adjusted by a movable arc limit stop that is coupled to a toggle member only at drive reversal, and the sprinkler may be converted to full circle operation by raising the arc limit stop relative to a cooperating trip tab. A buckling spring assembly used to shift the drive comprises a compression spring held between two spaced pivot members, and the drive can be built in continuous and intermittent drive versions by replacing a few normal rotary gears with multilated gears. A friction clutch having asymmetric teeth for smooth operation prevents damage to the drive during forced nozzle rotation. A nozzle assembly includes a pivotal nozzle that carries a radius adjustment screw with the head of the screw received on top a flexible portion of a top cover, which top cover has laser etched indicia relating to various adjustments of the sprinkler. A flow shut off valve includes stream straightening vanes and a collar may be used to support the sprinkler on a stake or post for above ground installation.

26 Claims, 29 Drawing Sheets

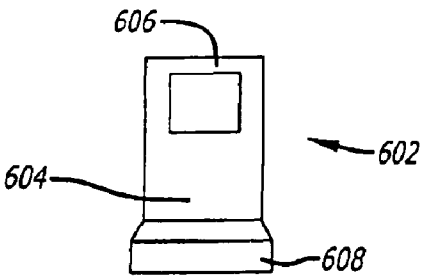
FIG. 41A
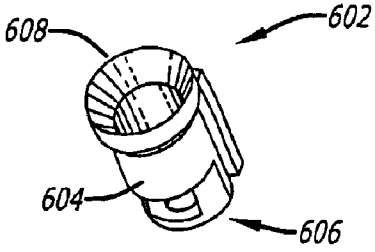
FIG. 41B
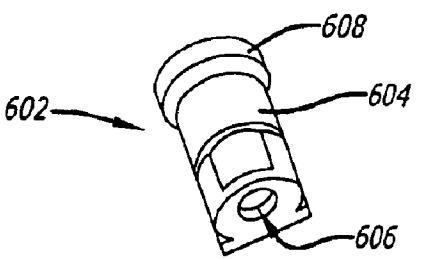
FIG. 41C
FIG. 41D
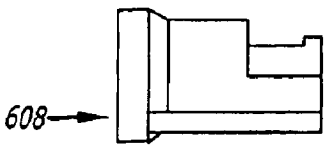
FIG. 41E
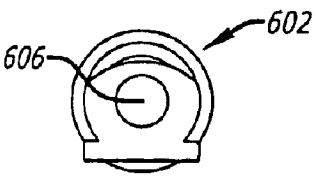
FIG. 41F
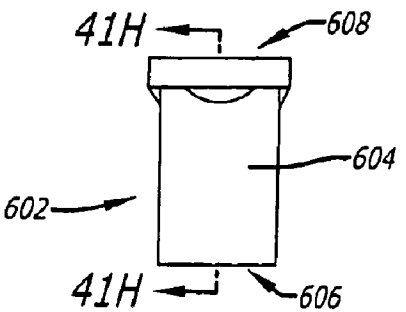
FIG. 41G
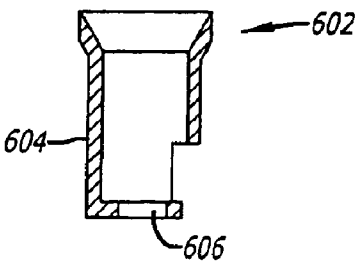
FIG. 41H

ROTARY SPRINKLER WITH ARC ADJUSTMENT GUIDE AND FLOW-THROUGH SHAFT

CROSS REFERENCE TO RELATED APPLICATIONS

This application claims the benefit of one or more previously filed copending provisional applications identified as follows: application Ser. No. 60/386,520 filed Jun. 5, 2002, which is incorporated by reference. This application is also a continuation in part of U.S. application Ser. No. 10/014,916 filed Oct. 22, 2001, which, in turn, claims priority to provisional patent application Ser. No. 60/243,538 filed Oct. 26, 2000.

TECHNICAL FIELD

This invention relates to a rotary sprinkler having a rotatable nozzle assembly for watering an arc of ground traversed or swept by the nozzle assembly as the nozzle assembly rotates. More particularly, this invention relates to a sprinkler of this type in which the trajectory of the water being thrown by the nozzle assembly can be easily adjusted, in which the arc of ground being watered by the nozzle assembly can be easily adjusted, and which includes an indicator for indicating both the angular extent and the direction of the arc of ground being watered by the nozzle assembly, among other things.

BACKGROUND OF THE INVENTION

Rotary sprinklers are known which have rotary nozzle assemblies that oscillate back and forth through an adjustable arc of rotation to water an adjustable arc segment on the ground. Some such sprinklers have indicators for indicating to the user the angular extent of the arc segment that has been set by the user. These indicators are typically carried on the rotary nozzle assembly which moves relative to the rest of the sprinkler. Thus, such indicators do not continuously or absolutely indicate to the user the direction in which the arc segment is oriented, which would be useful information for the user to have.

In addition, many arc indicators comprise an angular scale and a cooperating pointer. Typically, the scale and pointer are relatively small. This can make them somewhat difficult to read. Accordingly, there is a need in the art for an arc indicator which may be more easily read and which more graphically represents the angular extent of the arc indicator without having to read a pointer against a numerical scale.

Prior art rotary sprinklers are typically provided with some type of arc adjusting mechanism, often comprising two arc limit stops which are relatively adjustable to one another. Such stops are typically carried adjacent to one another with the stops being continuously coupled to a part of the drive reversing mechanism. In adjusting one stop relative to another, the adjustable stop(s) are often necessarily ratcheted over serrations or detents, thus making adjustment somewhat difficult or unnatural. No rotary sprinklers are known in which the stops are freely adjustable relative to one another with the adjustable stops being coupled to the drive reversing mechanism only at moments of drive reversal.

Some rotary sprinklers of this type can be adjusted between part circle and true full circle operation. This is done by having the arc limit stops abut one another when the sprinkler is set to 360ø such that the trip mechanism rides over the abutted arc limit stops without tripping. Other sprinklers require one of the arc limit stops to be manually pivoted up out of the way of the trip mechanism. No rotary sprinklers are known in which one of the arc limits stops is automatically moved vertically up out of the way of the trip mechanism whenever the sprinkler is set to 360ø to automatically convert to full circle operation.

Rotary sprinklers having oscillating drives often use springs as part of the mechanism which toggles a shiftable part of the drive to reverse the drive direction. Some such springs are elongated leaf springs which buckle between their top and bottom ends. Such leaf springs are somewhat difficult to manufacture and are somewhat less durable than would otherwise be desirable. A buckling spring assembly using a simple compression spring would be desirable but is not known in prior art sprinklers.

Rotary sprinkler drives are known that provide continuous motion and other rotary sprinkler drives are known that provide intermittent motion. These drives have in the past been built as separate drives and not as drives that are different versions of a common drive. A method of manufacturing a common drive which is easily manufactured in a continuous or intermittent version would be desirable.

Rotary sprinklers having rotary drives often include some type of clutch that allows the rotary nozzle assembly to be forced past the drive without damaging the drive. Some such clutches comprise detent or serration type clutches as well as simple friction clutches. It would be desirable to have a clutch that acts like a friction clutch in terms of smoothness of operation but which has some opposed teeth to enhance the holding power of the clutch. It would also be desirable to have such a clutch which retains its holding ability even after the clutch is exposed to the various contaminants that are found in the water flowing through the sprinkler.

Rotary nozzle assemblies as used on various types of sprinklers have previously been provided with nozzles whose trajectory can be adjusted. However, such nozzle assemblies have not included those which use radius adjustment screws to selectively break up the stream from the nozzle to shorten the radius. Such nozzle assemblies equipped with radius adjustment screws have not been adjustable in trajectory. It would be desirable to have a trajectory adjustable nozzle that also includes a radius adjustment screw.

Rotary sprinklers have been equipped with flow shut off valves that involve placing an elongated member into the water flow path through the nozzle. Such an elongated member disturbs the water stream flowing through the nozzle, which is obviously undesirable. A way to overcome this water disturbance phenomenon would be an advantage.

Rotary sprinklers having different types of adjustments are known with the covers of such sprinklers having indicia to instruct or inform the user about the adjustments or how to make the adjustments. Such indicia have in the past been difficult to read. A way to improve the readability of the indicia would be a step forward in the art.

While rotary sprinklers are often buried in the ground, they are sometimes tied to stakes or posts extending up out of the ground. This is usually done simply by tying the sprinkler body to the post using wire or cords or some other relatively crude connection. A more elegant and stable method of securing the sprinkler to a stake or post would be desirable.

SUMMARY OF THE INVENTION

One aspect of this invention is to provide a rotary sprinkler which waters an adjustable arc segment on the ground which includes an arc indicator that both indicates the angular extent of the arc segment as well as absolutely indicates where that arc segment is directed relative to the ground. Another aspect of this invention is an arc indicator that comprises a band with a visible length in place of the more commonly known pointer and cooperating numerical scale.

Another aspect of this invention is to provide a rotary sprinkler with an adjustable are segment defined by the distance between two arc limit stops. An adjustable arc limit stop is connected to a toggle member only at moments of drive reversal. Yet another aspect of this invention relates to converting a rotary sprinkler to full circle operation by automatically moving at least one of the arc limit stops out of engagement with a trip tab whenever the sprinkler is set to water 360ø.

Another aspect of this invention is in a rotary sprinkler having a shiftable or reversible oscillating drive including a buckling spring. In this aspect of the invention, the buckling spring includes a compression spring whose ends are secured to first and second pivot members. The compression spring buckles between its ends as one pivot member pivots relative to the other pivot member.

Yet another aspect of this invention is to provide a rotary drive for a sprinkler that can be easily built in intermittent or continuous drive versions. A continuous drive version is built in which all the gears are normal rotary gears with regularly shaped teeth. To build the intermittent version of the drive, a few of the normal rotary gears in the continuous drive version of the drive are replaced with multilated gears.

Another aspect of this invention relates to a friction clutch for preventing damage to a rotary sprinkler drive during periods of forced nozzle rotation. Such a friction clutch includes opposed sets of teeth on the clutch members with the teeth being asymmetrically arranged relative to one another. An O-ring is placed between the teeth of the clutch members. In yet another aspect of this invention, the O-ring is pre-lubricated in an oil to compensate for the effects of the contaminants typically found in the water flowing through the sprinkler.

Another aspect of this invention relates to a rotary sprinkler having a rotary nozzle assembly in which the nozzle is pivotal to have its trajectory adjusted. In this aspect of the invention, the pivotal nozzle is carried in a cradle that also carries a radius adjustment screw so that the radius adjustment screw pivots with the nozzle to maintain a fixed relationship to the nozzle once the screw has been adjusted. In yet another aspect of this invention, the radius adjustment screw has an enlarged head carried on top of a flexible portion of the cover which flexible cover portion can tilt or flex relative to the rest of the cover as the nozzle trajectory changes. This permits the radius adjustment screw to be operated from above the sprinkler despite any changes in the nozzle trajectory.

Another aspect of this invention relates to a stream straightener having flow straightening vanes to lessen any disturbance which the stream straightener might otherwise impose on the water flowing through the sprinkler.

Another aspect of this invention relates to a rotary sprinkler having a cover which carries indicia relating to various adjustments of the sprinkler, the indicia having been laser etched onto the cover.

Yet another aspect of this invention relates to a removable member that can be attached to a sprinkler to more easily attach the sprinkler to an upstanding stake for above ground installation of the sprinkler.

BRIEF DESCRIPTION OF THE DRAWINGS

This invention will be described hereafter in the Detailed Description, taken in conjunction with the following drawings, in which like reference numerals refer to like elements or parts throughout.

FIGS. 41A–41H are various front, cross-sectional and perspective views of an arc adjustment guide in accordance with a preferred embodiment of the present invention; and, FIG. 42 is a top partial cross-sectional view of a rotary sprinkler in accordance with a preferred embodiment of the present invention.

DETAILED DESCRIPTION

Introduction

Figure 1:
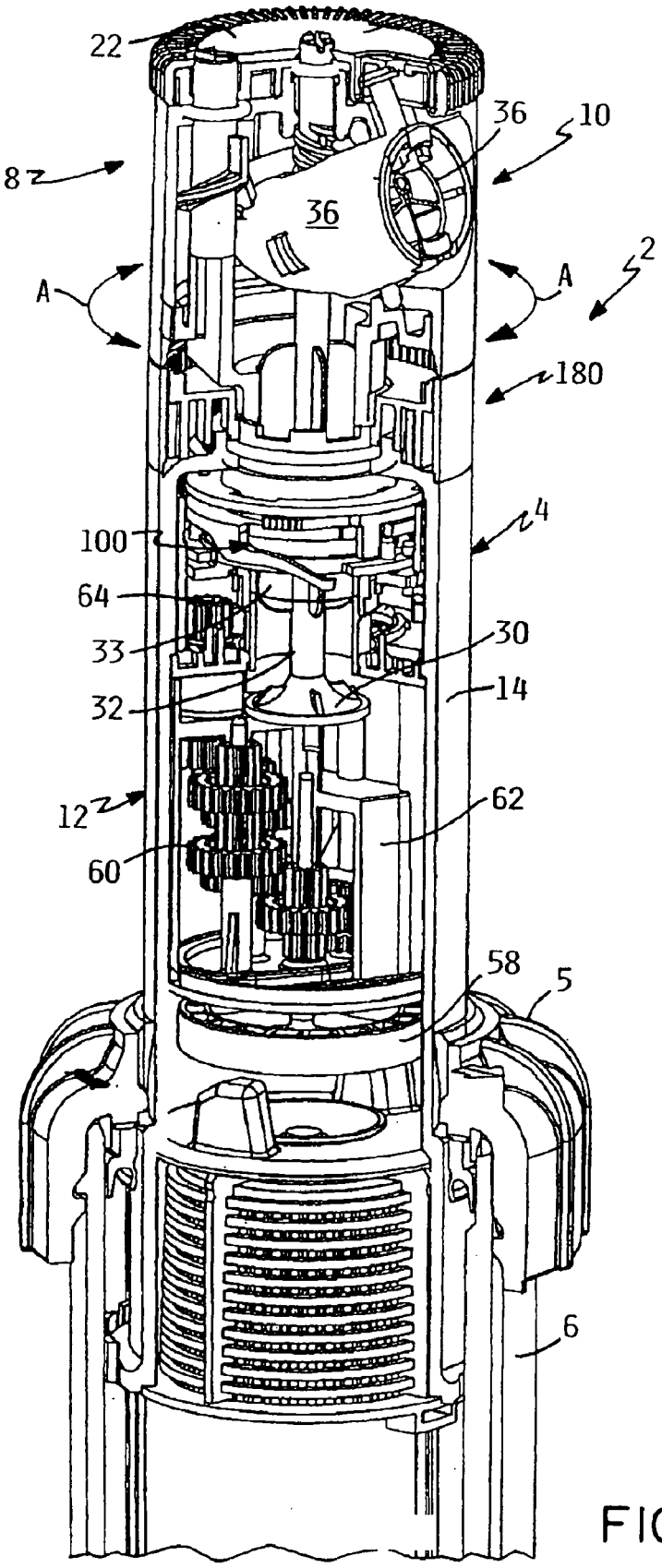
FIG. 1 is a perspective view of a sprinkler according to this invention, showing the sprinkler riser popped up, and with a portion of the sprinkler body and sprinkler riser being broken away to show various internal components of the sprinkler, the bull gear being omitted from this view for the purpose of clarity.
Figure 2:
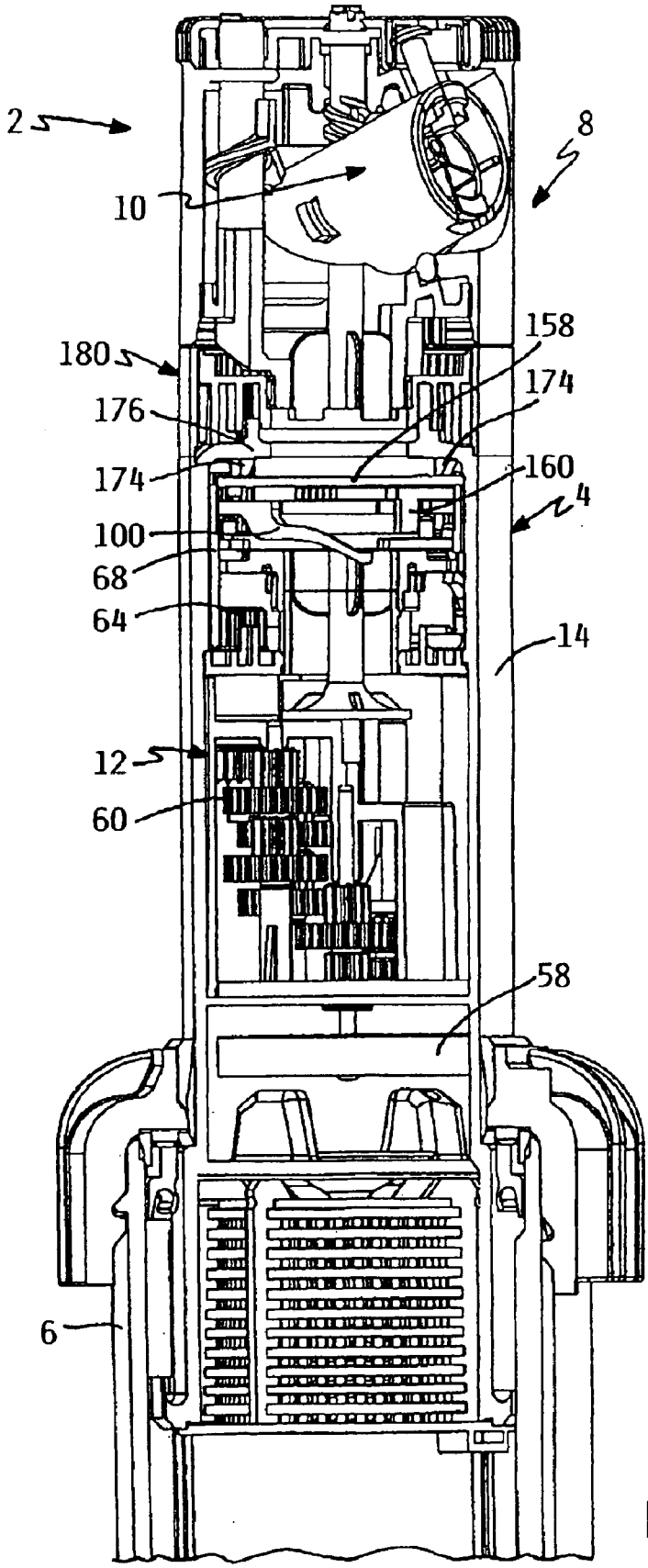
FIG. 2 is a side elevational view of a sprinkler according to this invention, showing the sprinkler riser popped up, and with a portion of the sprinkler body and sprinkler riser being broken away to show various internal components of the sprinkler, the bull gear being omitted from this view for the purpose of clarity.

Referring first to FIGS. 1 and 2, this invention relates to a water sprinkler, generally identified as 2 in the drawings, for irrigating an area of ground or turf. Sprinkler 2 preferably comprises a pop-up sprinkler in which a pop-up riser 4 is reciprocally carried within an outer sprinkler body 6. When water pressure is not present within the interior of sprinkler body 6, riser 4 is retracted by a retraction spring (not shown) within sprinkler body 6 so that the top of riser 4 is generally flush with a cap 5 on the top of sprinkler body 6. However, when water pressure is present within sprinkler body 6, as when a valve upstream of sprinkler body 6 or within the water inlet of sprinkler body 6 in the case of a valve-in-head sprinkler is opened, such water pressure acts against riser 4 to pop riser 4 up out of sprinkler body 6. FIGS. 1 and 2 illustrate riser 4 in its popped up orientation. When riser 4 pops up, a nozzle assembly 8 at the top of riser 4 is exposed to allow the water entering sprinkler 2 through the inlet to be ejected by at least one nozzle 10 carried in nozzle assembly 8.

Riser 4 preferably houses a rotary drive 12 for rotating nozzle assembly 8 about a substantially vertical axis. Riser 4 itself preferably has two major components. The first riser component is a non-rotatable drive housing 14 in which rotary drive 12 is housed. The second riser component is a rotatable nozzle assembly 8 which sits atop drive housing 14. During operation of sprinkler 2, nozzle assembly 8 rotates relatively to drive housing 14 as illustrated by the arrows A in FIG. 1.

The Fuzzy Assembly

Referring now to FIGS. 3–7, nozzle assembly 8 includes a nozzle housing 16 having a generally cylindrical form. Nozzle housing 16 includes a cylindrical sidewall 18 and a top wall 20 fixedly secured thereto. A flexible rubber cover 22 is adhered to top wall 20 of nozzle housing 16 by attaching cover 22 to a retainer plate 21, which retainer plate 21 is itself fixedly attached to top wall 20 thereby trapping various O-ring seals between plate 21 and top wall 20. See FIGS. 3 and 5. Sidewall 18 of nozzle housing 16 includes an outwardly extending cavity or seat 24 in which nozzle 10 is received for throwing a stream of water to one side of nozzle assembly 8.

Nozzle assembly 8 includes a downwardly extending water supply tube 26 that conducts water passing up through drive housing 14 into the interior of nozzle housing 16. This water will pass outwardly through nozzle 10 in a stream like form.

The Flow Shut Off Valve

A manually operable flow shut off valve 28 can be installed on the centerline of nozzle housing 16. Flow shut off valve 28 has a valve member 30 for stopping water from flowing into water supply tube 26 when valve member 30 is engaged with the end of water supply tube 26. Flow shut off valve 28 has a shaft 32 with a threaded section 31 that permits the user to unscrew flow shut off valve 28 to move valve member 30 down away from water supply tube 26 sufficiently to allow water to pass through water supply tube 26 into nozzle housing 16. Shaft 32 of flow shut off valve 28 has an opening 29 in its top end to allow a tool, such as a screwdriver, to be used to rotate shaft 32. A plurality of stream straightening vanes 33 are provided on shaft 32 for engaging the inner diameter of water supply tube 26, such vanes 33 helping guide shaft 32 up and down within water supply tube 26 as well as reducing turbulence in the flow passing through water supply tube 26.

The Pivotal Nozzle

Nozzle assembly 8 of sprinkler 2 of this invention includes a nozzle 10 that is pivotally mounted within nozzle housing 16. Nozzle 10 comprises a cylindrical nozzle body 35 pivotally received in a nozzle cradle 34 for pivoting motion about a substantially horizontal pivot axis to adjust the trajectory of the water stream exiting from nozzle body 35. A removable nozzle member 36 having a nozzle outlet 38 is press fit or otherwise removably but tightly secured in the outer end of pivotal nozzle body 35. Different nozzle plates 36 having differently shaped or sized nozzle outlets 38 can thus be fit into nozzle body 35 to vary the shape or gallonage of the water stream being thrown by nozzle body 35.

Pivotal nozzle body 35 includes a seat 44 on one side forming a gap 45 which receives a thread or worm 46 on a trajectory setting shaft 48. Trajectory setting shaft 48 is vertically oriented and is rotatably journalled at its lower end on a pivot pin 50 in the inside of nozzle housing 16. Trajectory setting shaft 48 runs to the top of nozzle housing 16 and its top end has an opening shaped to receive a screwdriver or similar tool. The top end of trajectory setting shaft 48 is accessible through a hole 52 in cover 22 of nozzle assembly 8. When trajectory setting shaft 48 is rotated, the engagement of worm 46 on shaft 48 with seat 44 on nozzle body 35 pivots nozzle body 35 to raise or lower the outer end of nozzle body 35 to thereby adjust the trajectory of nozzle body 35. Thus, rotating trajectory setting shaft 48 in one direction will pivot the outer end of nozzle body 35 upwardly to raise the trajectory of the water stream being thrown by nozzle body 35. Rotating trajectory setting shaft 48 in the opposite direction will pivot the outer end of nozzle body 35 downwardly to lower the trajectory of the water stream being thrown by nozzle body 35.

Figure 3:
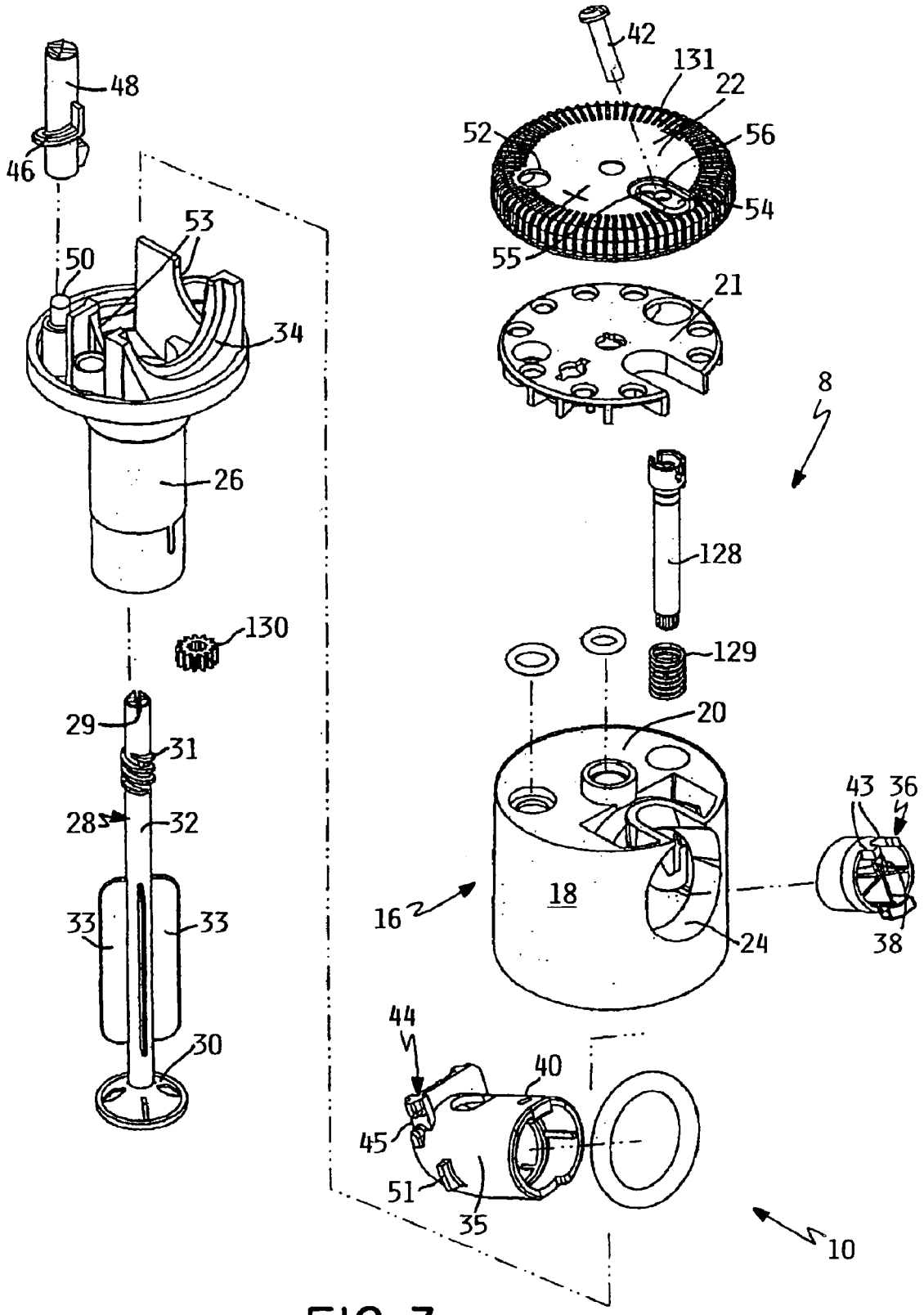
FIG. 3 is an exploded perspective view of the nozzle assembly of the sprinkler shown in FIG. 1.
Figure 5:
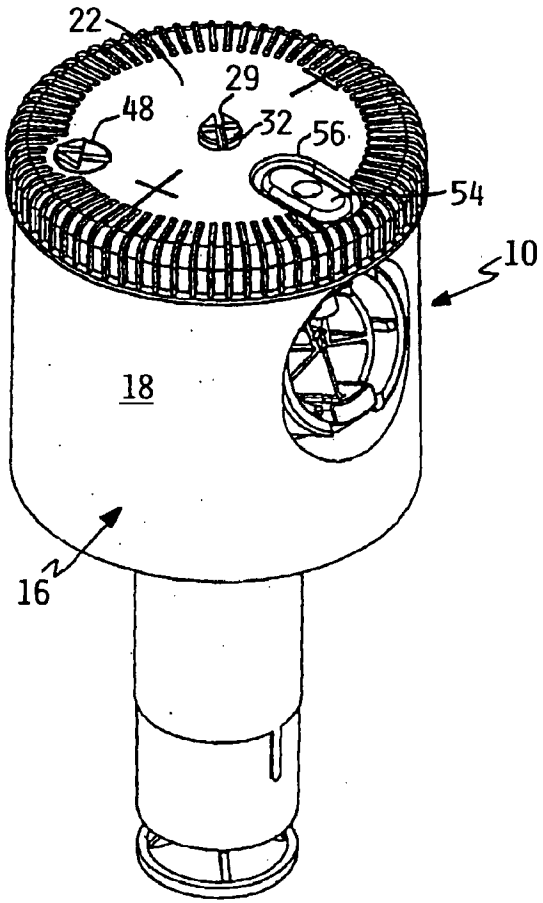
FIG. 5 is a perspective view of the nozzle assembly of the sprinkler shown in FIG. 1 looking down at the nozzle assembly.
Figure 4:
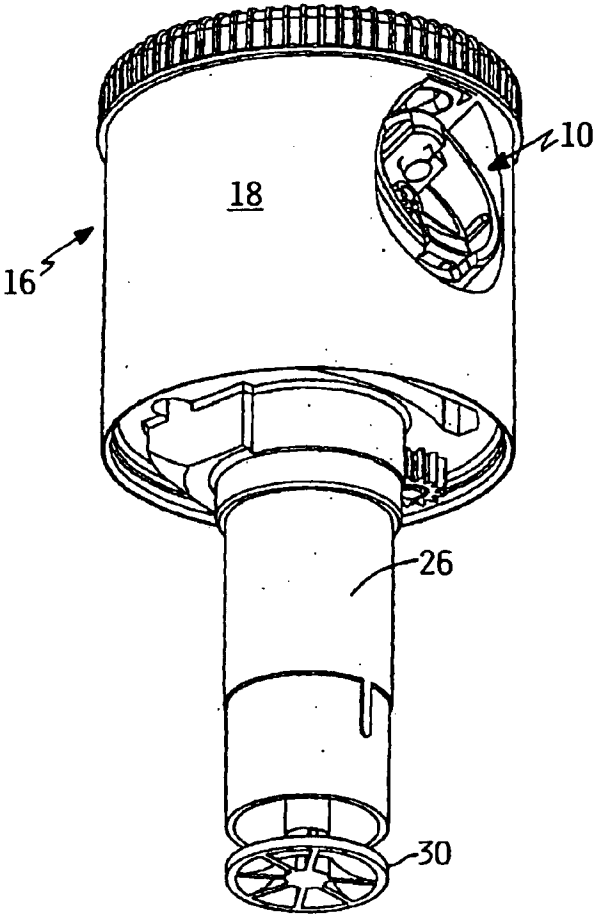
FIG. 4 is a perspective view of the nozzle assembly of the sprinkler shown in FIG. 1 looking up at the nozzle assembly.

Nozzle body 35 can be pivotally mounted in nozzle housing 16 in any suitable manner. One way to do this is shown in FIG. 3. Nozzle body 35 is formed with curved tabs 51 extending to each side with only one such tab 51 being shown in FIG. 3. Such curved tabs 51 are captured in curved slots within housing 16 to form a pivotal connection with nozzle housing 16. Nozzle housing 16 has two lower curved surfaces shown at 53 in a portion of nozzle housing 16. When nozzle housing 16 is assembled together, two other upper curved surfaces (not shown) will overlie and be spaced from the two lower curved surfaces 53 to form two curved slots in which tabs 51 will be captured. Rotating trajectory setting shaft 48 will pivot nozzle body 35 about a horizontal axis with tabs 51 riding or sliding up or down on lower curved surfaces 53 of the slots as nozzle body 35 pivots.

The advantages of being able to adjust the trajectory of the water stream being thrown by pivotal nozzle 10 are apparent. It allows the user to select or adjust the trajectory without having to install different nozzles on sprinkler 2.

To assist the user in adjusting the trajectory, rubber cover 22 can be marked with indicia which indicates to the user the directions to turn trajectory setting shaft 48 to increase or decrease the trajectory and which indicates the maximum and minimum trajectory angles. This is further described in the following section of this Detailed Description entitled The Indicia on the Cover.

The Radius Adjustment Screw

As shown in FIG. 3, nozzle body 35 includes an opening 40 into which the lower end of a radius adjustment or stream break up screw 42 is threaded. Nozzle member 36 includes alignment fingers 43 between which radius adjustment screw 42 will pass when nozzle body 35, nozzle member 36 and radius adjustment screw 42 are all properly assembled together. Threading radius adjustment screw 42 up or down in opening 40 on nozzle body 35 will cause the lower end of radius adjustment screw 42 to move into or out of the stream exiting from nozzle outlet 38 in nozzle member 36. This will cause the radius of the stream to shorten or lengthen, respectively, due to stream break up. Such radius adjustment screws 42 are well known in sprinklers of this type.

Because radius adjustment screw 42 is carried on pivotal nozzle 10 itself by virtue of being carried on pivotal nozzle body 35, radius adjustment screw 42 also travels with nozzle 10 during a trajectory adjustment. Thus, radius adjustment screw 42 is always available for use regardless of the selected trajectory.

The top of radius adjustment screw 42 is preferably retained above cover 22 of nozzle assembly 8 to allow radius adjustment screw 42 to be quickly located and rotated. Normally, in sprinklers of this general type, the cover of the sprinkler has a hole or slit through which a tool can be inserted to reach and rotate the radius adjustment screw. However, because radius adjustment screw 42 is carried on a pivotal nozzle to swing or tilt relative to cover 22, it would be more difficult to access the head of screw 42 by sticking a tool down through a hole or slit and blindly trying to find the screw head since the screw head no longer necessarily remains aligned with the access hole or slit. Accordingly, in this invention, the head of radius adjustment screw 42 is always visible on top of cover 22 to allow the user to easily locate the screw head and to insert an adjustment tool into the screw head.

To locate the head of radius adjustment screw 42 atop cover 22 and to permit movement of screw 42 relative to cover 22, flexible rubber cover 22 is provided with a screw head receiving portion 54 having an opening 55 through which the shank of screw 42 extends with the head of screw 42 being retained on top of screw head receiving portion 54. See FIG. 3. This screw head receiving portion 54 of rubber cover 22 can flex or bend with respect to the rest of cover 22 since portion 54 is separated from the rest of cover 22 by a channel 56 and is only connected to the rest of cover 22 by a thin membrane 57 at the bottom of channel 56. See FIG. 6. Thus, as the trajectory of nozzle body 35 changes and as the top of radius adjustment screw 42 tilts relative to rubber cover 22, or as screw 42 is adjusted upwardly and downwardly, both this tilting and up and down movements of the top of the radius adjustment screw 42 are accommodated since screw head receiving portion 54 of cover 22 can similarly tilt or be compressed relative to the rest of cover 22 without distorting or deforming the rest of cover 22.

The Rotary Drive

Figure 24:
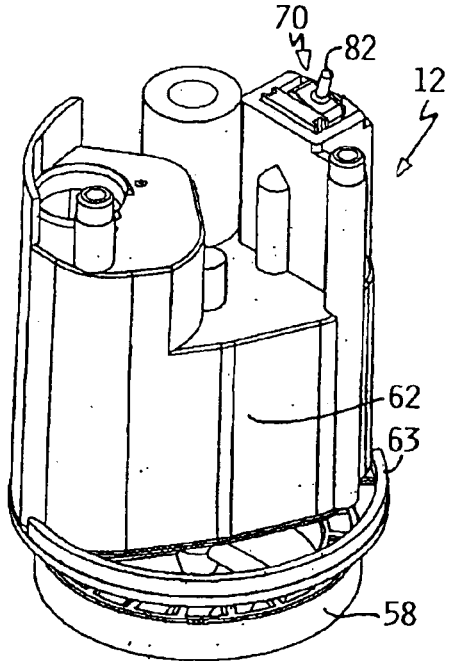
FIG. 24 is a perspective view of a typical rotary drive used in the sprinkler of FIG. 1.

Rotary drive 12 can have different forms. One form of rotary drive 12, and the form illustrated in FIGS. 1, 2 and 24, comprises a speed reducing gear drive carried within drive housing 14. Rotary drive 12 has a turbine 58 at its lower end, a gear train 60 including a plurality of speed reducing gear stages stacked above turbine 58 with the gear stages being located in a gear case 62, and an output gear 64. Turbine 58 is exposed to the water flowing through sprinkler 2 such that turbine 58 is spun or rotated at relatively high speed by the water flow. Gear train 60 progressively slows the rotational speed so that output gear 64 is rotated at a much slower speed, and correspondingly at higher power or torque, than turbine 58. Output gear 64 meshes with a bull gear 66, which drives nozzle assembly 8, such that bull gear 66 rotates at an even slower speed than output gear 64 of gear train 60. Accordingly, nozzle assembly 8 is rotated by bull gear 66 at a very low speed compared to the speed of rotation of turbine 58.

Continuous or Intermittent Drive

Rotary sprinkler gear drives of this type are well known in the sprinkler art. The gears within such a drive 12 can be shaped to provide continuous, albeit slow speed, rotation of output gear 64. Alternatively, if so desired, some of the gears within the drive can comprise the multilated gearing disclosed in U.S. Pat. No. 5,758,827, assigned to the assignee of this application, which patent is herein incorporated by reference. When such multilated gearing is used, rotary drive 12 provides a periodic pause in the rotation of output gear 64 such that nozzle assembly 8 is both slowly and intermittently driven. In other words, when such multilated gearing is used, nozzle assembly 8 will slowly rotate, will pause or stop momentarily, will slowly rotate again, will pause or stop momentarily again, and so on. Continuous or intermittent rotation is provided by the nature of drive 12 installed into sprinkler 2 when sprinkler 2 is built, i.e. intermittent rotation will be provided when a drive 12 built with the multilated gearing of U.S. Pat. No. 5,758,827 is used and continuous rotation will be provided when a drive built with conventional gearing is used.

Figure 28:
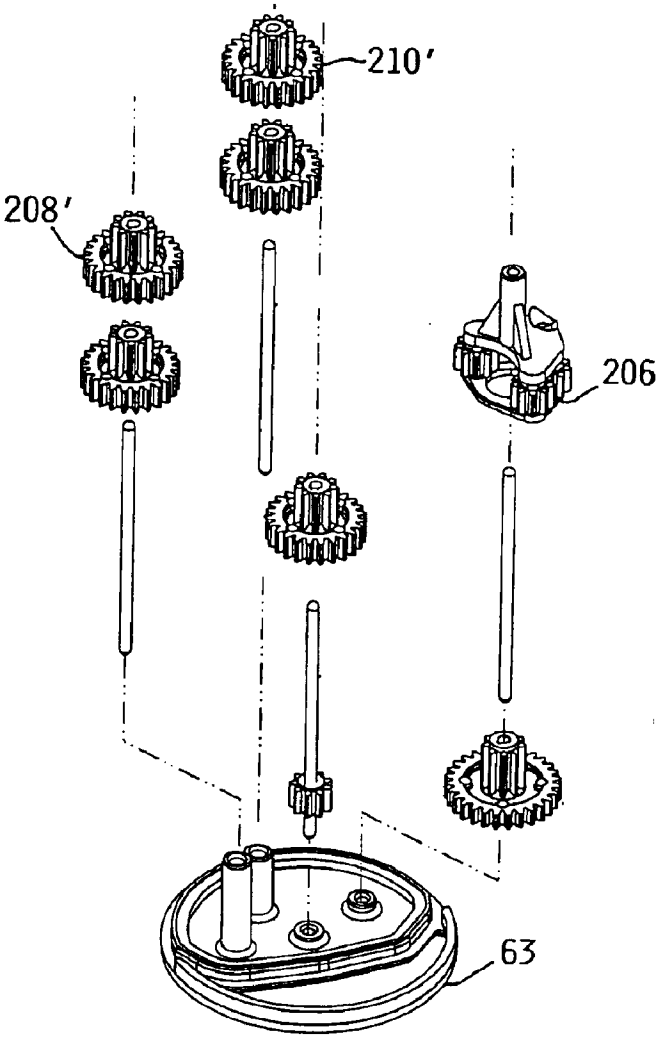
FIG. 28 is an exploded perspective view, similar to FIG. 27, of a portion of a second embodiment for the drive shown in FIG. 24, particularly illustrating a rotary drive designed to provide continuous rotation.
Figure 27:
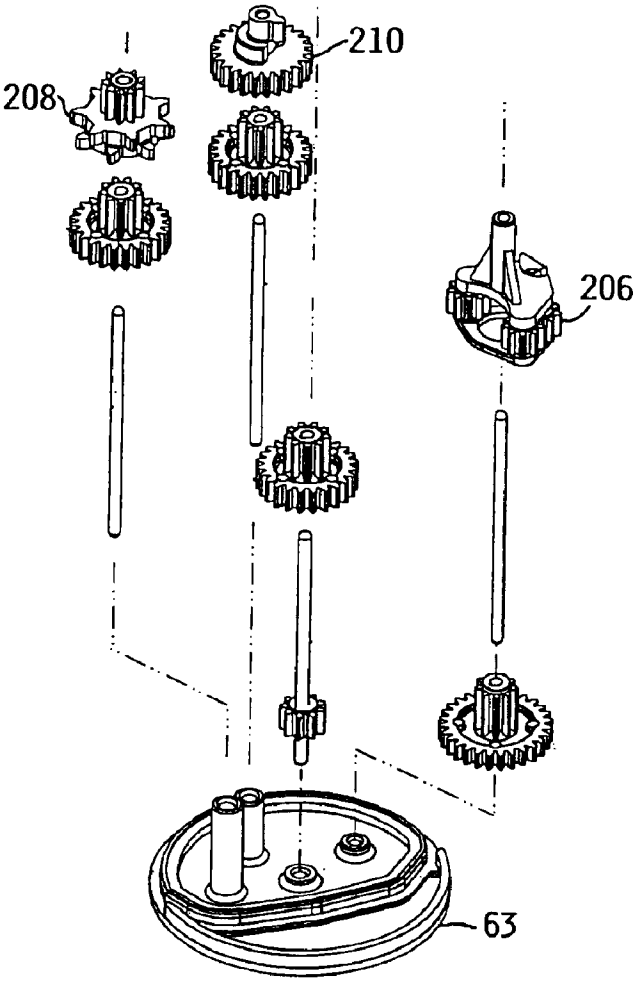
FIG. 27 is an exploded perspective view of a portion of a first embodiment for the drive shown in FIG. 24, particularly illustrating a rotary drive designed to provide intermittent rotation.

The Applicants have realized that sprinklers 2 can be easily built with either a continuous or intermittent drive by standardizing much of the drive and only changing a few gears therein when the drive is built. This is illustrated in FIGS. 27 and 28, which show the speed reducing gear stages of gear train 60 in an exploded form, such stages normally being enclosed within gear case 62. The only part of gear case 62 shown in FIGS. 27 and 28 is the base 63 thereof.

In any event, by comparing FIGS. 27 and 28, it is seen that the two drives are identical except for the last two speed reducing gears. In the continuous drive illustrated in FIG. 28, these last two speed reducing gears 208' and 210' have conventional gear teeth throughout. However, in the intermittent drive illustrated in FIG. 27, these last two speed reducing gears 208 and 210 are the multilated gearing disclosed in U.S. Pat. No. 5,758,827. Since the two drives except for the last two speed reducing gears within the gear case are otherwise identical, both drives can be quickly and inexpensively manufactured. One can easily select whether a continuous or intermittent drive is provided simply by selecting which gears 208 and 210, or 208' and 210', to use as the last two speed reducing gears in gear train 60.

For any particular drive 12 that is used, i.e. whether such is a continuous or intermittent drive, rotary gear drive 12 is able to provide oscillating rotation of nozzle assembly 8. In other words, drive 12 will rotate nozzle assembly 8 first in one direction and will then reverse nozzle assembly 8 to rotate nozzle assembly 8 in the opposite direction. Such oscillating rotation will be provided between two arc limit stops 98 and 100 such that sprinkler 2 will water an arc segment that is controlled by the angular distance between the two stops. In other words, if arc limit stops 98 and 100 are set apart to provide quarter circle rotation, then nozzle assembly 8 will rotate or oscillate back and forth within a 90ø arc to water a quarter of a circle. Similarly, if arc limit stops 98 and 100 are set further apart to provide half circle rotation, then nozzle assembly 8 will rotate or oscillate back and forth within a 180ø arc to water a half circle.

Oscillating rotation is achieved by shifting a reversing gear plate (shown at 206 in FIGS. 27 and 28) located within gear train 60 at a point near turbine 58 where the torque is low. A shiftable, cylindrically shaped toggle member 68 located above gear case 62 is connected to the reversing gear plate by a vertically extending buckling spring assembly 70 which extends down into gear case 62 along the side of gear train 60. When toggle member 68 is toggled back and forth about a vertical axis, buckling spring assembly 70 will be buckled back and forth between oppositely disposed over center positions, to thereby shift the reversing gear plate back and forth between one of two different drive positions. In one drive position, the reversing gear plate interposes one gear into gear train 60 to achieve rotation of output gear 64 in a first direction. In the other drive position, the reversing gear plate interposes another oppositely rotating gear into gear train 60 to achieve rotation of output gear 64 in a second opposite direction. The details of the reversing gear plate, shiftable toggle member, and a buckling spring assembly are disclosed in U.S. Pat. No. 5,673,855, assigned to the assignee of this invention, which patent is also incorporated above by reference.

The Buckling Spring Assembly

Figure 26:
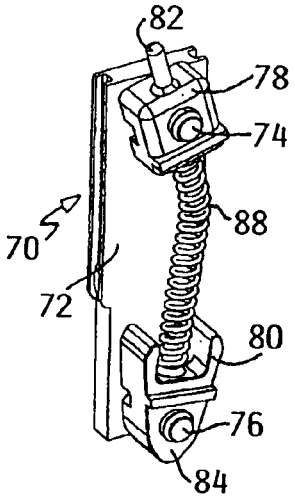
FIG. 26 is a perspective view of the buckling spring assembly shown in FIG. 25.
Figure 25:
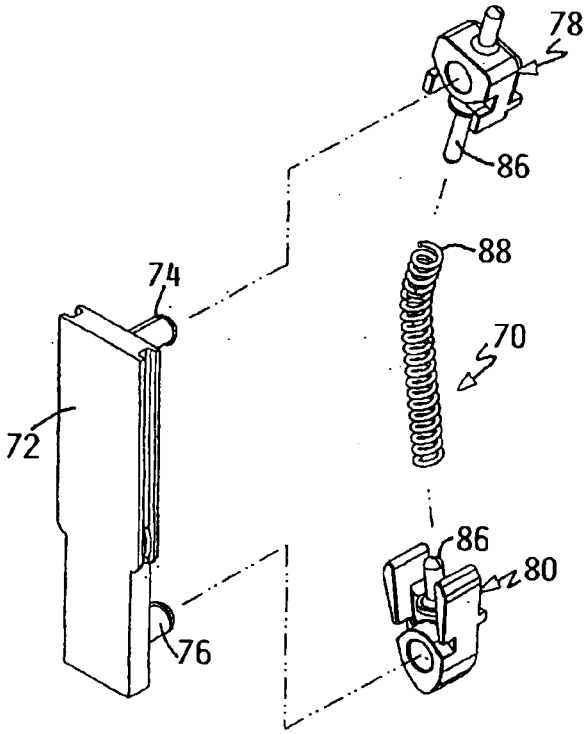
FIG. 25 is an exploded perspective view of a buckling spring assembly used in the drive of FIG. 24.

Referring to FIGS. 25 and 26, an improved buckling spring assembly 70 is disclosed formed by a base plate 72 having vertically spaced pivot pins 74 and 76 extending to one side of base plate 72. An upper pivot member 78 is pivotally journalled around upper pivot pin 74 and a lower pivot member 80 is pivotally journalled around lower pivot pin 76. Upper pivot member 78 has an upwardly extending rod 82 which enters into an opening in toggle member 68 to allow movement of toggle member 68 to act on upper pivot member 78 to toggle or pivot upper pivot member 78 about upper pivot pin 74. Lower pivot member 80 has a downwardly extending rounded end 84 which engages the reversing gear plate to toggle the gear plate back and forth to shift or reverse rotary drive 12.

The facing surfaces of the upper and lower pivot members 78 and 80 include facing dowels 86 on which the ends of a typical compression spring 88 are received. Thus, when upper pivot member 78 is toggled by movement of toggle member 68, upper pivot member 78 will eventually pivot. As upper pivot member 78 passes over the center of upper pivot pin 74, upper pivot member 78 acts on the top end of compression spring 88, eventually causing spring 88 to flip or buckle over between its two oppositely buckled, stable positions. FIG. 26 shows spring 88 in one of its two buckled stable positions. As spring 88 buckles, the buckling action of spring 88 will pivot or toggle lower pivot member 80 about lower pivot pin 76, thereby acting on the reversing gear plate to shift or reverse the direction of rotary drive 12.

In U.S. Pat. No. 5,673,855, previously referred to above, the buckling spring was a leaf type spring. Buckling spring assembly 70 disclosed herein, including the use of a simple compression spring 88 mounted between rotatable pivot members 78 and 80, is easier to manufacture, more reliable and less costly than the previously used leaf type spring.

Arc Adjustments and Part Circle Operation

The Toggle Assembly

Figure 8:
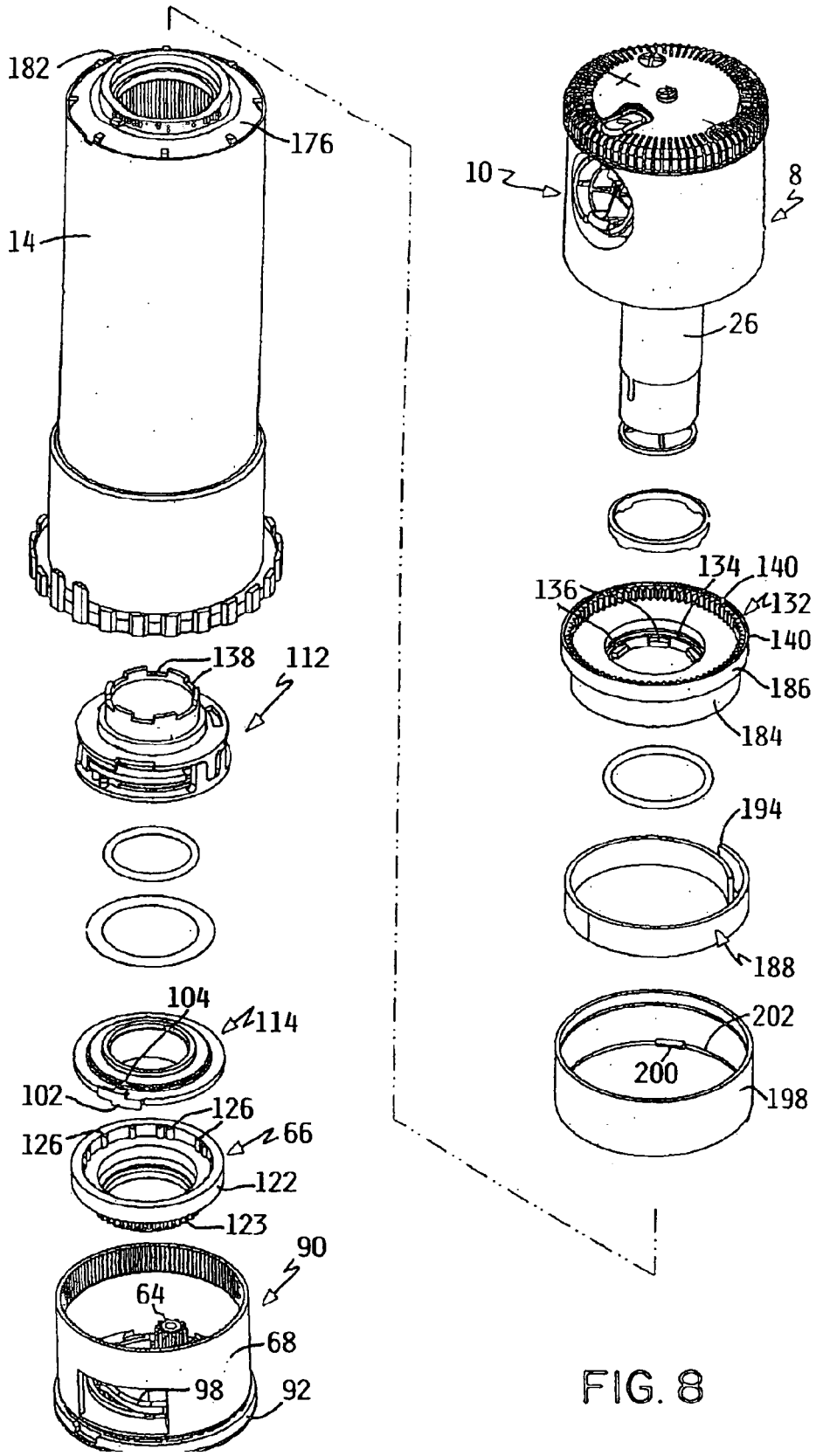
FIG. 8 is an exploded perspective view of some portions of the riser of the sprinkler shown in FIG. 1, particularly illustrating the arc adjustment member and the arc indicator beneath the nozzle assembly on the right side of the drawing and the adjustable stop assembly, the trip plate, the bull gear and the toggle assembly beneath the riser housing on the left side of the drawing.
Figure 18:
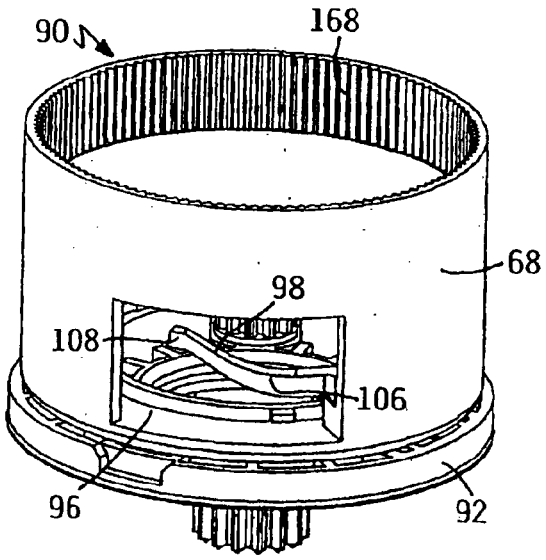
FIG. 18 is a perspective view of the toggle assembly shown in FIG. 8.
Figure 19:
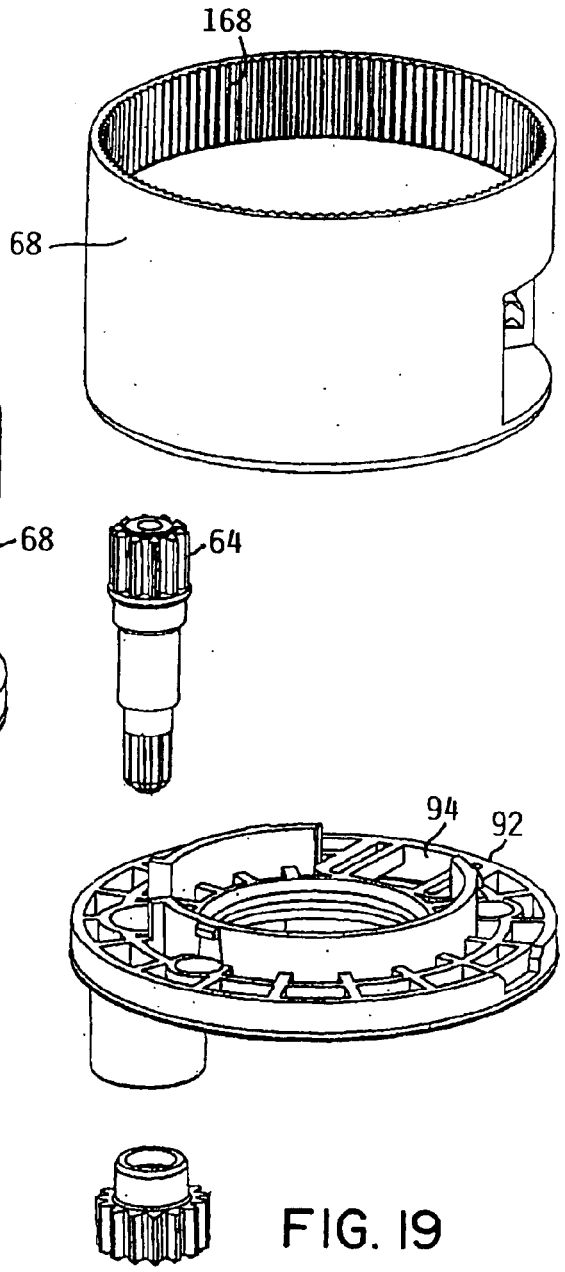
FIG. 19 is an exploded perspective view of the toggle assembly shown in FIG. 8.

Referring now to FIGS. 8, 18 and 19, a toggle assembly 90 includes a toggle base 92 that is fixed inside drive housing 14 to form a support for shiftable toggle member 68. Toggle member 68 is cylindrically shaped and sits on top of toggle base 92, moving slightly back and forth on toggle base 92 as toggle member 68 is toggled. The upwardly extending rod 82 on upper pivot member 78 of buckling spring assembly 70 extends up through a wide aperture 94 in toggle base 92 into a hole on a lower rim or flange 96 of toggle member 68. In addition, output gear 64 of rotary drive 12 is located within cylindrical toggle member 68 to allow output gear 64 to engage bull gear 66. Bull gear 66 is not shown in FIGS. 18 and 19 but is shown in FIG. 8.

Figure 10:
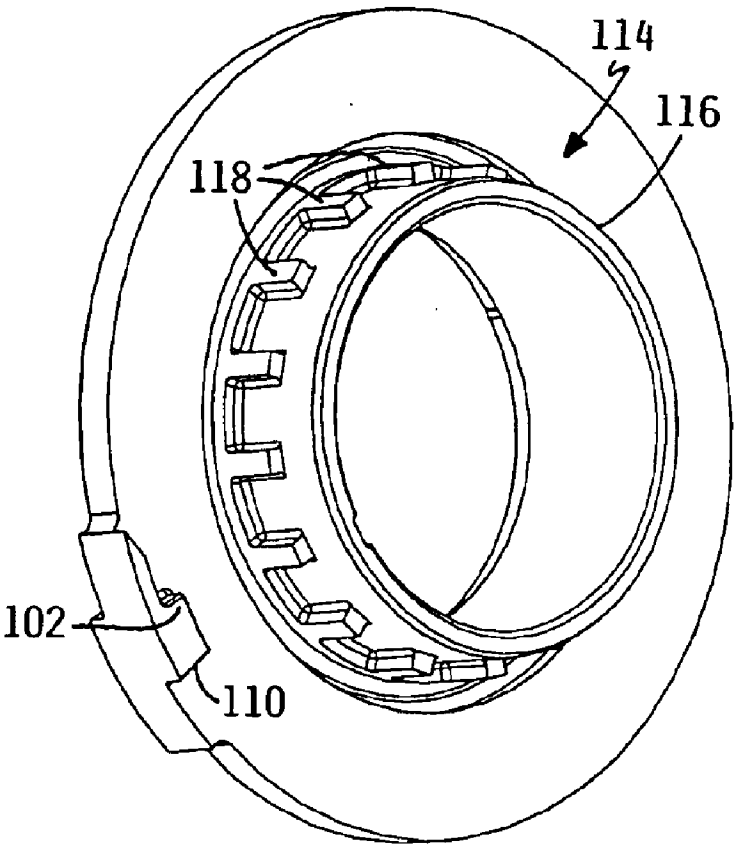
FIG. 10 is a perspective view of the trip plate shown in FIG. 8 looking up at the trip plate.
Figure 9:
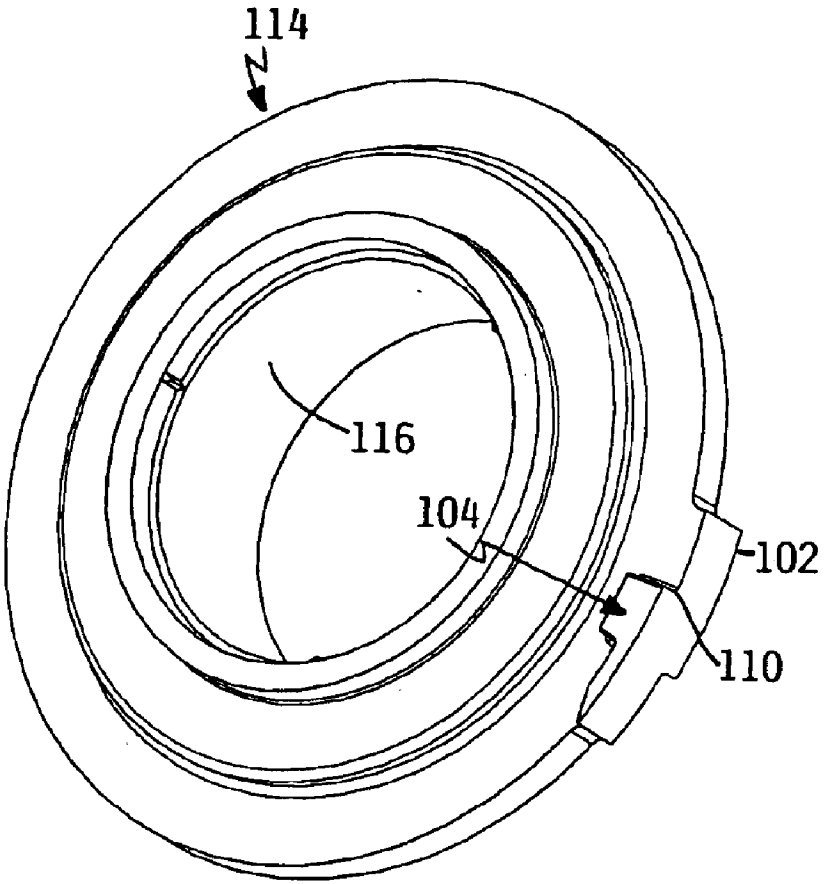
FIG. 9 is a perspective view of the trip plate shown in FIG. 8 looking down at the trip plate.
Figure 13:
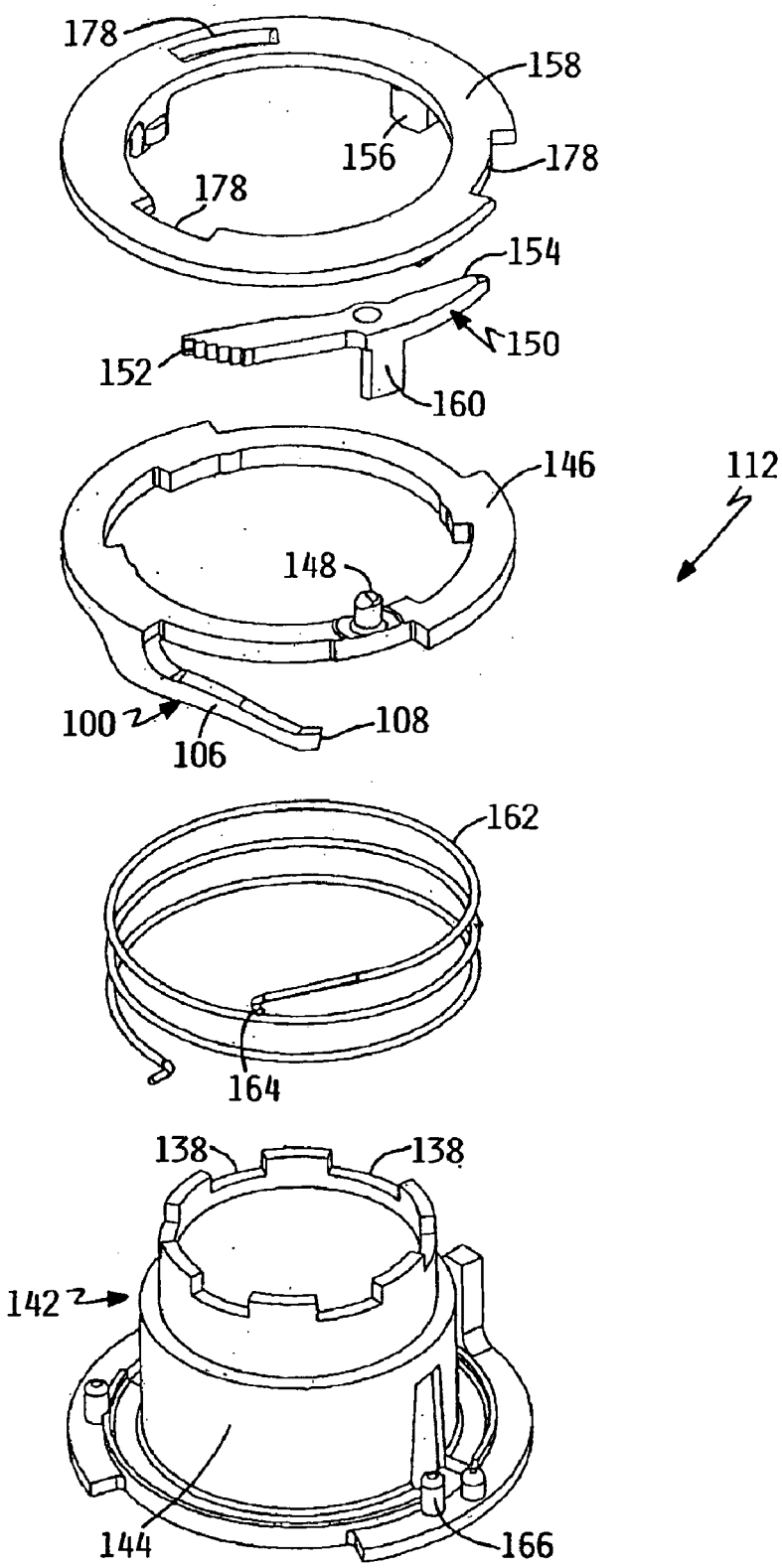
FIG. 13 is an exploded perspective view of the adjustable stop assembly shown in FIG. 8.

First and second arc limit stops 98 and 100 are provided which coact with first and second trip tabs 102 and 104 to toggle or shift toggle member 68 back and forth between the two positions of toggle member 68. Trip tabs 102 and 104 are shown in FIGS. 9 and 10. Each arc limit stop 98 and 100 comprises a flexible ramp shaped arm 106 having a free outer end 108 that normally engages against a flattened surface 110 on one trip tab 102 or 104. As shown in FIG. 18, first arc limit stop 98, comprising an upwardly extending ramp shaped arm 106, is fixed on toggle member 68. As shown in FIG. 13, second arc limit stop 100, comprising a downwardly extending ramp shaped arm 106, is carried on an adjustable stop assembly 112, to be described hereafter.

Before describing the structure of adjustable stop assembly 112, the structure and location of trip tabs 102 and 104 and how they interact with first and second arc limit stops 98 and 100 will be described.

The Trip Plate

Referring again to FIGS. 9 and 10, an annular trip plate 114 has a central hub 116 which is fixedly attached to the downwardly extending water supply tube 26 of nozzle assembly 8. This fixed attachment between annular trip plate 114 and nozzle assembly 8 can be made by any suitable method, i.e. by sonic welding the inner diameter of hub 116 of annular trip plate 114 to water supply tube 26 of nozzle assembly 8. The outer diameter of hub 116 carries a set of vertical drive teeth 118. Torque is transferred to trip plate 114 from rotary drive 12 by a friction clutch 120 interposed between rotary drive 12 and the vertical drive teeth 118 on trip plate hub 116. Thus, the entire nozzle assembly 8 is driven by virtue of the rotary torque applied to trip plate 114 and by the fixed, non-rotary attachment of trip plate 114 to nozzle assembly 8.

Referring to FIG. 8 and again to FIGS. 9 and 10, trip plate 114 carries first and second trip tabs 102 and 104 for engagement by first and second arc limit stops 98 and 100. Trip tabs 102 and 104 comprise solid abutments integrally formed or molded on trip plate 114. First trip tab 102 extends downwardly from trip plate 114 to be engaged by first upwardly extending arc limit stop 98. Second trip tab 104 extends upwardly from trip plate 114 to be engaged by the second downwardly extending arc limit stop 100. Arc limit stops 98 and 100 and trip tabs 102 and 104 are configured so that one stop will engage against one trip tab, respectively, at the end of the selected arc of rotation when nozzle assembly 8 is moving in one direction while the other stop will engage against the other trip tab at the opposite end of the arc when nozzle assembly 8 is moving in the opposite direction. It is the engagement of each trip tab 102 and 104 with its corresponding arc limit stop 98 and 100 that shifts toggle member 68, and hence toggles buckling spring assembly 70 to shift the reversing gear plate, to cause reversal of rotary drive 12.

As noted earlier, each arc limit stop 98 or 100 comprises a flexible ramp shaped arm 106 having a free outer end 108 that normally engages against a flattened surface 110 on trip tab 102 or 104. During normal operation of sprinkler 2, the engagement of each stop with the trip tab effects drive reversal as noted above. However, in the case of forced nozzle rotation tending to drive the arc limit stop past the trip tab, the flexibility of arm 106 comprising the arc limit stop allows the arm to deflect past the trip tab without breaking either the arc limit stop or the trip tab. Then, when sprinkler 2 drive resumes, the arc limit stop can reset itself in relation to the trip tab, i.e. the arc limit stop can pass back past the trip tab into the desired position, without retripping toggle member 68. Again, arc limit stops and trip tabs which are shaped and which function in this manner are disclosed in U.S. Pat. No. 4,972,993, which is also incorporated by re

The Arc Adjustment

Figure 7:
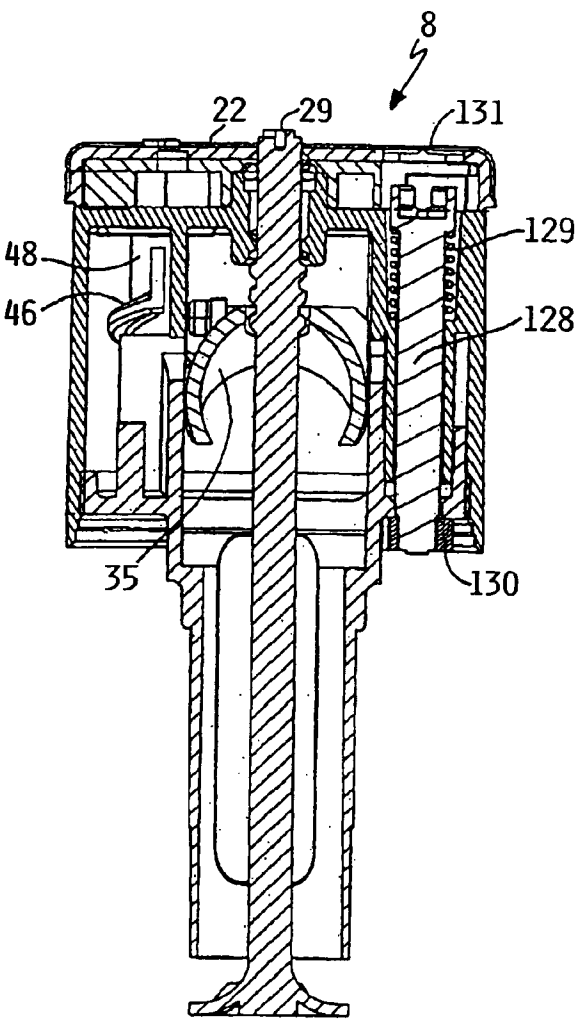
FIG. 7 is a cross-sectional view of the nozzle assembly shown in FIGS. 4 and 5, particularly illustrating the pivotal nozzle from the rear thereof and showing both the trajectory setting and arc setting shafts used to adjust the trajectory and the arc of rotation, respectively.
Figure 6:
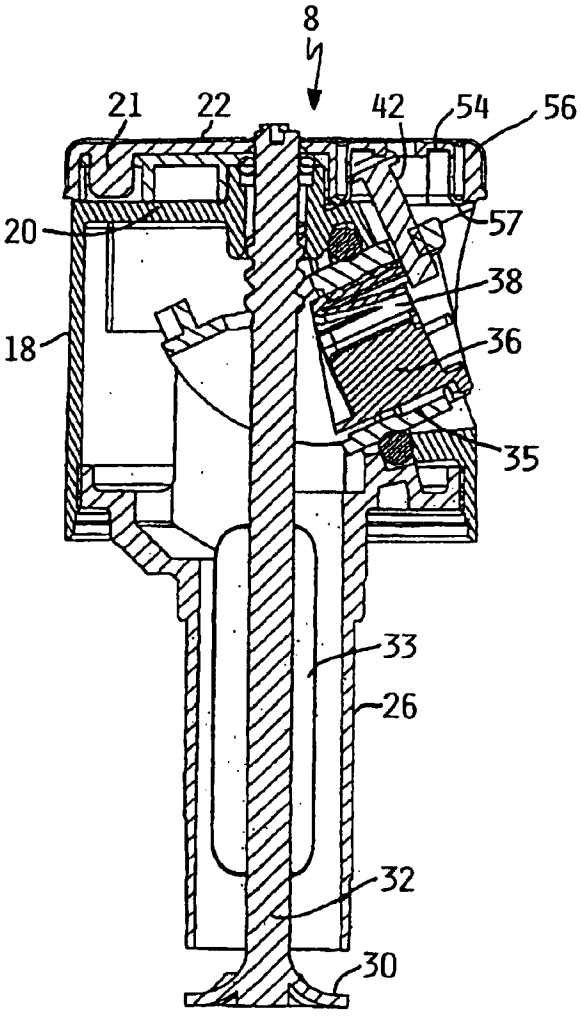
FIG. 6 is a cross-sectional view of the nozzle assembly shown in FIGS. 4 and 5, particularly illustrating the pivotal nozzle from the side thereof.

As noted earlier, the distance between the two arc limit stops 98 and 100 is adjustable to allow the user to set or adjust the arc of oscillation to any desired value. Referring to FIGS. 3 and 7, nozzle assembly 8 carries a selectively adjustable arc setting shaft 128 that can be manipulated by the user to adjust the arc of rotation of sprinkler 2 by rotating the adjustable arc limit stop. Arc setting shaft 128 runs vertically in a position that is offset from the center of nozzle assembly 8, has an upper end that is closely adjacent the top of nozzle assembly 8 to allow arc setting shaft 128 to be operated from above nozzle assembly 8, and has a gear 130 located on its lower end. The upper end of arc setting shaft 128 can be accessed by inserting a tool through a hole or slit 131 provided in rubber cover 22 overlying arc setting shaft 128. Arc setting shaft 128 is normally spring biased upwardly with gear 130 being located within the bottom of nozzle assembly 8.

An arc adjustment member 132 is carried immediately below nozzle assembly 8 on top of the non-rotatable drive housing 114 of riser 4. Arc adjustment member 132 has a central inner hub 134 that has a plurality of inwardly extending teeth 136 which interfit into a plurality of upwardly extending notches 138 on adjustable stop assembly 112. See FIG. 8. This interfitting tooth/notch structure non-rotatably couples arc adjustment member 132 to adjustable stop assembly 112. In other words, when arc adjustment member 132 is rotated relative to drive housing 14, adjustable stop assembly 112 is carried with it to be similarly rotated, thereby moving adjustable arc limit stop 100 carried on adjustable stop assembly 112 towards or away from fixed arc limit stop 98.

Figure 29:
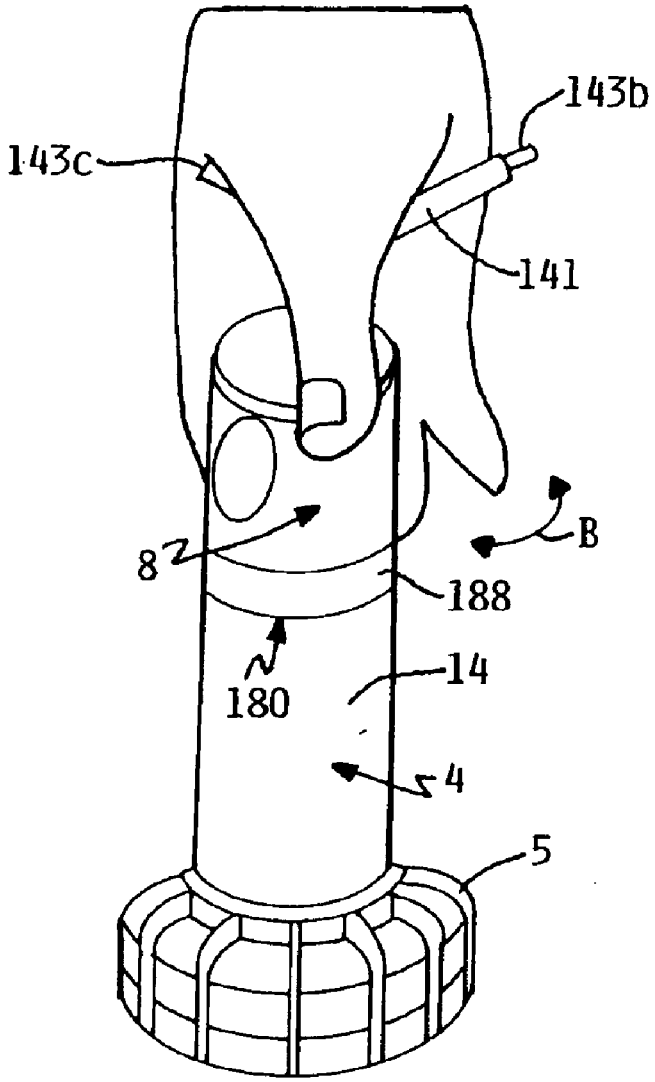
FIG. 29 is a perspective view of one hand of a user using a tool to push down on arc setting shaft while the user's hand grips the nozzle assembly during an arc adjustment operation.
Figure 30:
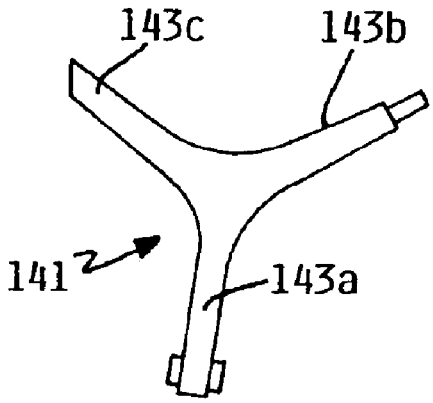
FIG. 30 is a side elevational view of the tool shown in FIG. 29.

To adjust the arc, the user pushes down on arc setting shaft 128 against the bias of the spring 129 that acts on shaft 128. This lowers gear 130 on arc setting shaft 128 out of nozzle assembly 8 and into engagement with an internal ring gear 140 carried on arc adjustment member 132. This couples or locks nozzle assembly 8 to arc adjustment member 132. Referring now to FIGS. 29 and 30, to keep nozzle assembly 8 locked to arc adjustment member 132, the user can hold arc setting shaft 128 down in this lowered position using a saddle shaped tool 141 having three stems 143*a–c*. One stem of this tool can be inserted into the top of arc setting shaft 128, this stem 143*a* extending vertically in FIG. 29 and being hidden by the user's thumb in FIG. 29 with the saddle formed between the other two stems 143*b* and 143*c* facing upwardly. As shown in FIG. 29, the edge of the palm of one of the user's hands can rest against the saddle formed by stems 143*b* and 143*c* of tool 141 while the user grabs nozzle assembly 8 with the thumb and some of the fingers of the same hand.

After arc setting shaft 128 is moved down into engagement with arc adjustment member 132 and is held there, the user can then rotate nozzle assembly 8 in one direction or the other using the hand that grips nozzle assembly 8. Drive housing 14 will remain stationary as it is keyed or splined to sprinkler body 6 which itself is non-rotatable since sprinkler body 6 is buried in the ground and non-rotatably installed on irrigation piping. The rotation of nozzle assembly 8 relative to drive housing 14 is effectively coupled to arc adjustment member 132 through the interconnection of arc setting shaft 128, more specifically through the interconnection of gear 130 on arc setting shaft 128 to ring gear 140 on arc adjustment member 132, to thereby rotate arc adjustment member 132 and, thus, adjustable arc limit stop 100. When adjustable arc limit stop 100 reaches a new desired position, the user can let up on arc setting shaft 128 by releasing pressure from tool 141, thereby letting spring 129 move gear 130 on arc setting shaft 128 back up and out of engagement with ring gear 140 on arc adjustment member 132 and into nozzle assembly 8.

Saddle shaped tool 141 can have some of the stems 143 thereon differently shaped to engage with different ones of the adjustable components on sprinkler 2. Thus, as shown in FIG. 29, one stem 143*a* can be specially shaped to engage with the upper end of arc setting shaft 128. Some of the other stems 143*b* or 143*c* can be formed with screwdriver like blades or ends shaped to engage with the top of trajectory setting shaft 48, with the opening 29 in the top of flow shut off shaft 32, and/or with the top of radius adjustment screw 42. Alternatively, separate tools could be provided for each adjustment operation, though the use of a tool 141 with an upwardly facing saddle is useful during the arc adjustment operation as described above as it allows a place for the edge of the user's palm to rest as the user pushes down on the tool and grips nozzle assembly 8.

Instead of the arc adjustment operation described above, the arc can also be adjusted simply by pushing down on arc setting shaft 128 using stem 143*a* of tool 141 and by then rotating tool 141. This will rotate gear 130 on the end of arc setting shaft 128 to rotate arc adjustment member 132. In this mode of adjustment, the user simply needs to rotate tool 141 with one hand while holding nozzle assembly 8 steady with the user's other hand. However, whichever mode of adjustment is used, the net result is rotation of arc adjustment member 132 to rotate adjustable arc limit stop 100 relative to fixed arc limit stop 98.

Structure similar to the above described arc setting shaft and ring gear on an arc adjustment member is shown and described more fully in U.S. Pat. No. 5,695,123, assigned to the assignee of this invention, which is also incorporated by reference.

The Adjustable Stop Assembly

Adjustable stop assembly 112 has two purposes. The first purpose is to allow second arc limit stop 100 to be circumferentially moved towards or away from first arc limit stop 98 to adjust the arc of rotation provided by rotary drive 12. When the free outer ends 108 of the arms 106 that form arc limit stops 98 and 100 are separated a proper amount, then rotary drive 12 provides 90ø of rotation before reversing. If second arc limit stop 100 is moved another 90ø away from first arc limit stop 98, then rotary drive 12 provides 180ø of rotation before reversing. Similarly, moving second arc limit stop 100 towards first arc limit stop 98 will decrease the arc of rotation from its previous setting. Thus, the user can select a desired arc of rotation of rotary drive 12, and hence the arc segment watered by sprinkler 2, by appropriate adjustment of the second movable arc limit stop 100 towards or away from first arc limit stop 98.

As will be described in more detail hereafter in the section entitled Full Circle Operation, the second purpose of adjustable stop assembly 112 is to convert the rotation of nozzle assembly 8 from oscillating, part circle rotation (rotation in arcs less than 360ø) to unidirectional, full circle rotation (rotation of nozzle assembly 8 through a complete circle of 360ø). It is advantageous when watering a full circle to do so with a rotary drive 12 that rotates unidirectionally around and around in complete circles rather than with a drive that oscillates back and forth through 360ø. In the latter case of an oscillating drive that reverses the direction of rotation when the arc of rotation reaches 360ø, the arc setting is seldom exactly perfect such that the actual arc of rotation might be slightly less or more than 360ø. If the arc setting is slightly less than 360ø, there will be a wedge of ground or turf that will be unwatered. If the arc setting is slightly more than 360ø, there will be a wedge of ground or turf that is double watered compared to the rest of the pattern. Sprinkler 2 of this invention avoids these problems by permitting rotary drive 12 to rotate unidirectionally without reversing itself when second arc limit stop 100 is positioned for full circle or 360ø rotation.

Adjustable stop assembly 112 includes a base 142 having a central hub 144 which carries the upwardly extending notches 138 used to couple stop assembly 112 to arc adjustment member 132. Adjustable arc limit stop 100 is carried on an annular stop plate 146, the arm 106 forming adjustable arc limit stop 100 extending downwardly from stop plate 146. Stop plate 146 includes an upwardly extending pivot pin 148 on which a pawl 150 is pivotally carried. Pawl 150 has a toothed end 152 that is used during drive reversal to toggle or shift toggle member 68. The other end of pawl 150 is located on the opposite side of pivot pin 148 and includes a cam surface 154 that interacts with a cam 156 carried on an overlying full circle ring 158. Pawl 150 includes a downwardly extending finger 160.

Figure 15:
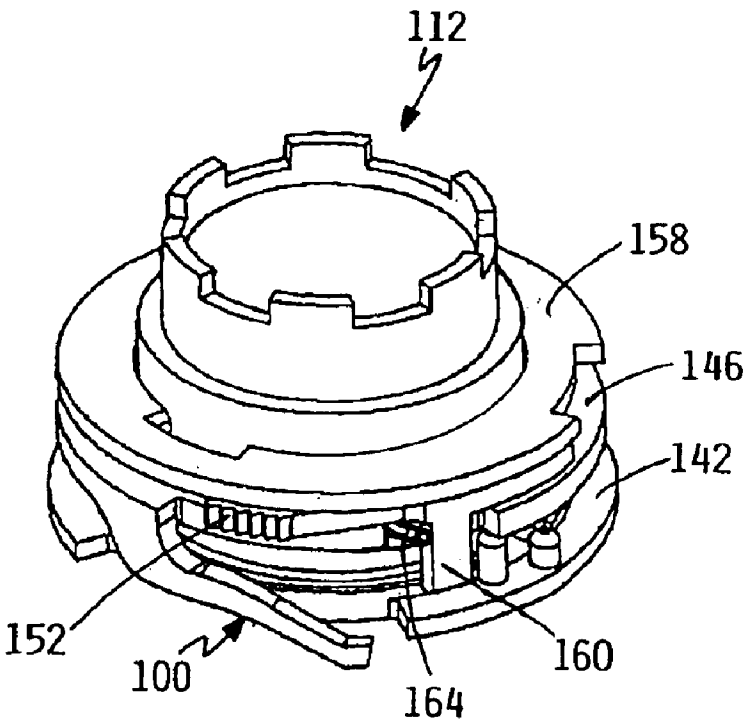
FIG. 15 is a perspective view, similar to FIG. 14, of the other side of the adjustable stop assembly shown in FIG. 14, particularly illustrating the adjustable arc limit stop.

A torsion spring 162 surrounds central hub 144 of base 142 and has its lower end fixed to base 142. The upper end 164 of torsion spring 162 extends radially outwardly and is engaged against one side of finger 160 on pawl 150. Spring 162 is arranged so that the torsional force of spring 162 acting against finger 160 on pawl 150 tends to move adjustable arc limit stop 100 into its normal operational position awaiting contact from its corresponding trip tab. This position is shown in FIGS. 15 and 16.

Figure 16:
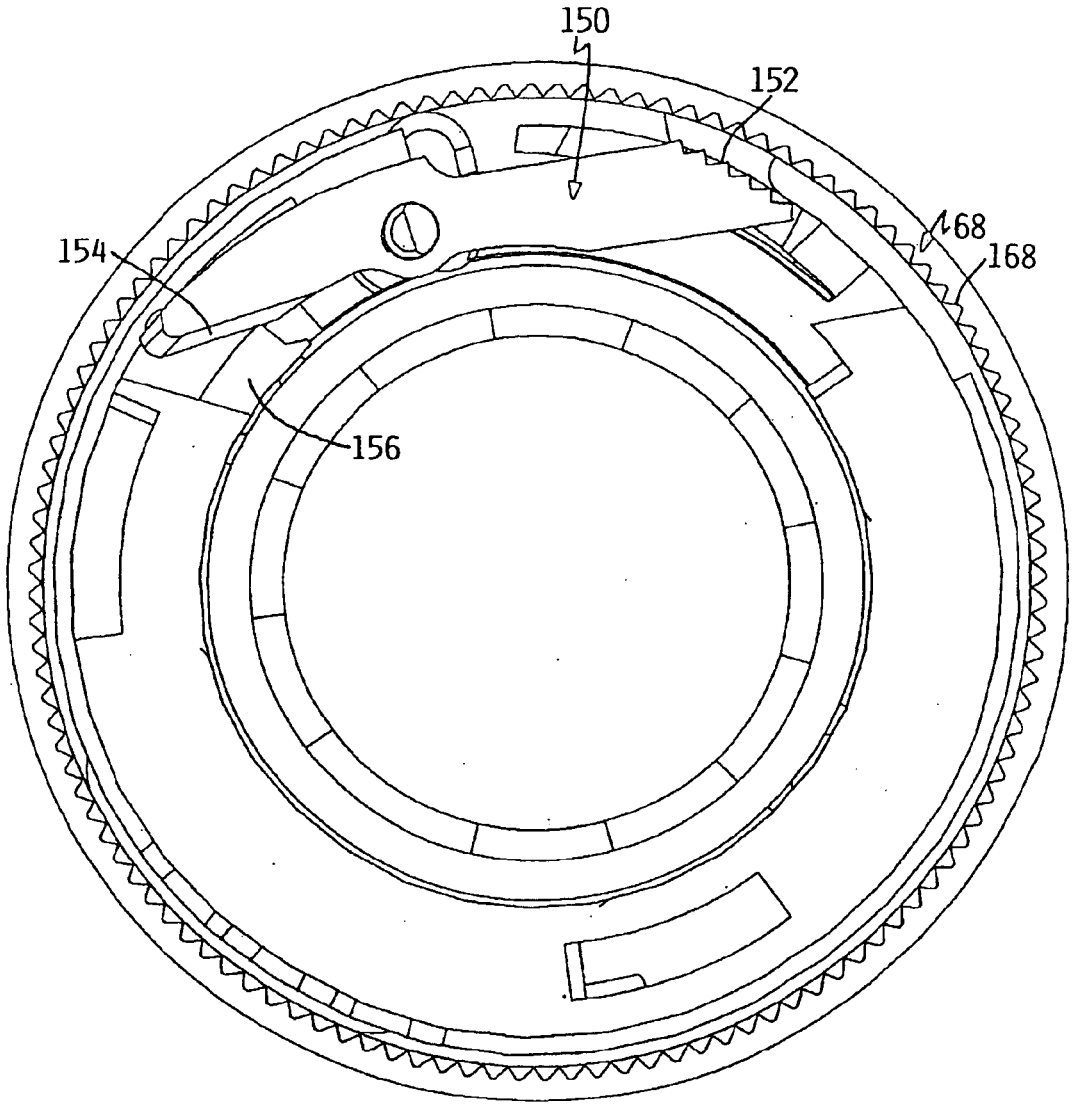
FIG. 16 is a top plan view of a portion of the adjustable stop assembly shown in FIG. 8, particularly illustrating the pivotal pawl of the adjustable stop assembly being pivoted inwardly relative to the stop assembly to be disengaged from the toggle member of the toggle assembly.

As shown in FIG. 16, in the normal operational position of adjustable arc limit stop 100, pawl 150 is pivoted about its pivot axis such that the toothed end 152 of pawl 150 is radially retracted inwardly relative to stop assembly 112. This occurs due to cam 156 carried on the overlying full circle ring 158. Cam 156 will engage with cam surface 154 on the other end of pawl 150 and will rotate pawl 150 in a clockwise direction about its pivot axis. When adjustable arc limit stop 100 has not yet been engaged by its trip tab with the components of adjustable stop assembly 112 positioned as shown in FIG. 15, cam 156 on full circle ring 158 holds pawl 150 in the retracted position of FIG. 16 with toothed end 152 of pawl 150 being swung radially inwardly relative to the outer diameter of stop assembly 112.

When trip tab 104 approaches and engages against the flattened outer end 108 of adjustable arc limit stop 1 00, trip tab 104 begins to push on stop 100, thereby rotating stop plate 146 carrying stop 100 relative to base 142. This carries pawl 150 with stop plate 146 as pawl 150 is connected to pivot pin 148 carried on stop plate 146. As pawl 150 moves with stop plate 146, cam surface 154 on the rear end of pawl 150 moves away from and eventually disengages cam 156 on full circle ring 158. As soon as this occurs, the torsional force of spring 162 is free to act against finger 160 of pawl 150 to cause pawl 150 to pivot in a counter-clockwise direction about pivot pin 148, thereby swinging toothed end 152 of pawl 150 radially outwardly past the outer diameter of stop plate 146. The net result of trip tab 104 engaging arc limit stop 100 carried on stop plate 146 is to rotate stop plate 146 and cause toothed end 152 of pawl 150 to move out from the side of adjustable stop assembly 112.

Figure 17:
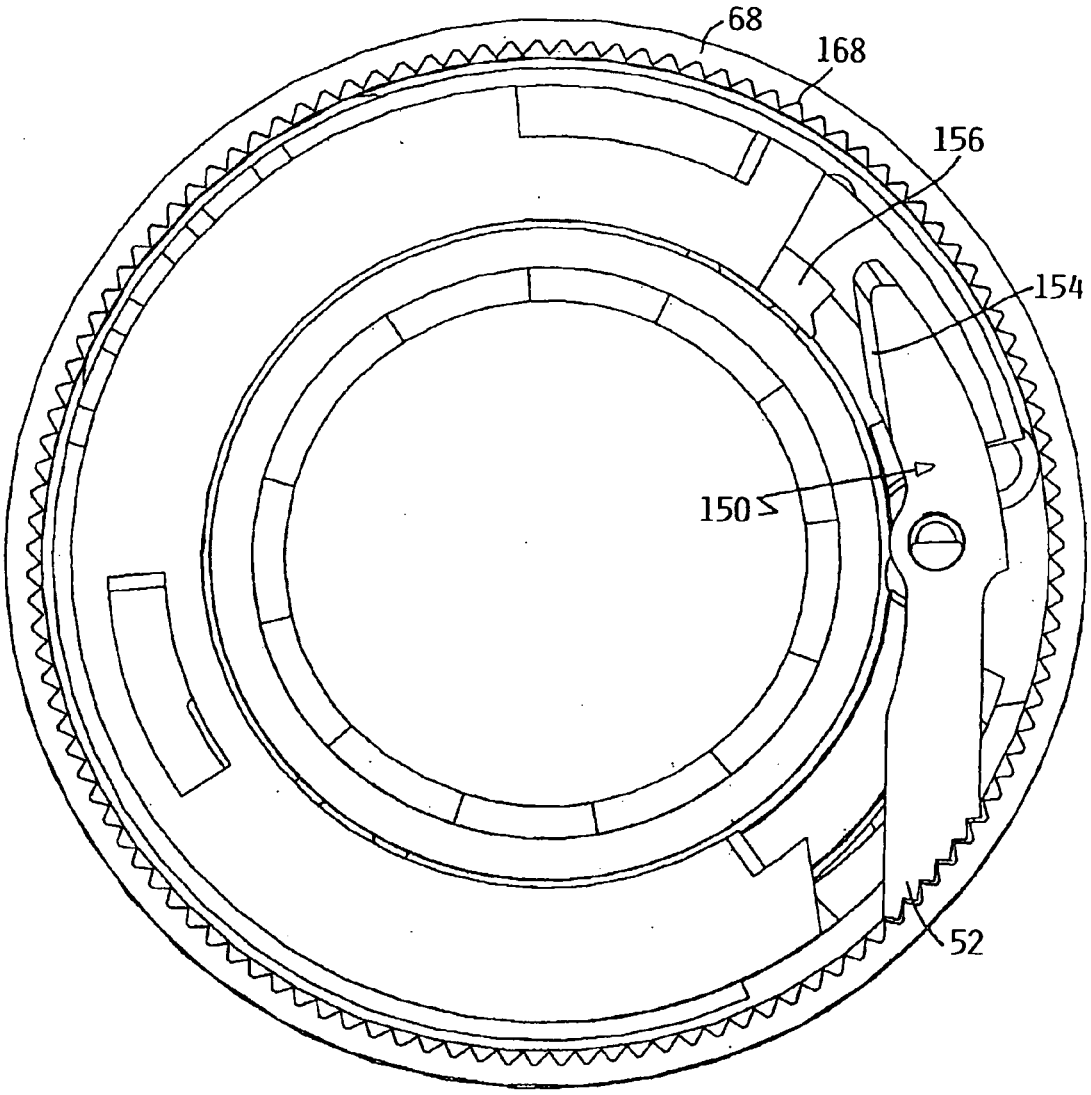
FIG. 17 is a top plan view, similar to FIG. 16, of a portion of the adjustable stop assembly shown in FIG. 8, particularly illustrating the pivotal pawl of the adjustable stop assembly being pivoted outwardly relative to the stop assembly to be engaged with the toggle member of the toggle assembly during a drive reversal operation.

As shown in FIG. 17, when toothed end 152 of pawl 150 swings out relative to adjustable stop assembly 112, it engages against various serrations in a serrated ring 168 carried at the top of the inside diameter of toggle member 68. Thus, the next bit of movement of adjustable arc limit stop 100 as it is being pushed by trip tab 104 is now coupled, through pawl 150, to toggle member 68 to rotate toggle member 68 in the appropriate direction to reverse rotary drive 12. As soon as rotary drive 12 reverses, trip tab 104 begins moving away from adjustable arc limit stop 100, thus allowing torsion spring 162 to begin pushing stop plate 146 back towards its normal operational position. As stop plate 146 moves back to this normal operational position, cam 156 on full circle ring 158 eventually engages cam surface 154 on the rear end of pawl 150 to pivot pawl 150 in a clockwise direction and thereby retract pawl 150 back into the outer diameter of stop assembly 112.

Thus, to summarize this portion of operation of adjustable stop assembly 112, stop assembly 112 carries adjustable arc limit stop 100 and is configured with a pivotal toothed pawl 150 that is normally retracted into stop assembly 112 when adjustable arc limit stop 100 is not being engaged by its trip tab 104. In this condition, there is no connection between stop assembly 112 and toggle member 68 carrying the fixed or non-adjustable arc limit stop 98. Thus, when stop assembly 112 is itself rotated in the arc adjustment procedure described above, it does not carry with it toggle member 68 such that the distance between the adjustable and non-adjustable arc limit stops 100 and 98 actually changes. If pawl 150 were constantly in engagement with toggle member 68, then no arc adjustment would occur since the rotation of stop assembly 112 would be transmitted to toggle member 68 as well, thereby not allowing relative movement between the two arc limit stops.

However, adjustable arc limit stop 100 must be coupled to toggle member 68 during the moment of desired drive reversal to toggle or shift toggle member 68 in one direction. That is why toothed pawl 150 is extended outwardly from stop assembly 112 as described above as trip tab 104 engages and pushes against adjustable arc limit stop 100. This movement of pawl 150 is for the purpose of coupling adjustable arc limit stop 100 to toggle member 68 during drive reversal, to allow further movement of adjustable arc limit stop 100 to be transferred to toggle member 68 to toggle or shift toggle member 68 in the appropriate direction.

Pawl 150 is needed only for drive reversal at one end of the arc of rotation since the other non-adjustable arc limit stop 98,is fixedly connected to toggle member 68 itself. Thus, when the other trip tab 102 engages and pushes against this fixed arc limit stop 98, it can toggle or shift toggle member 68 in the other direction without the need for any such pawl 150.

The Friction Clutch

Figure 12:
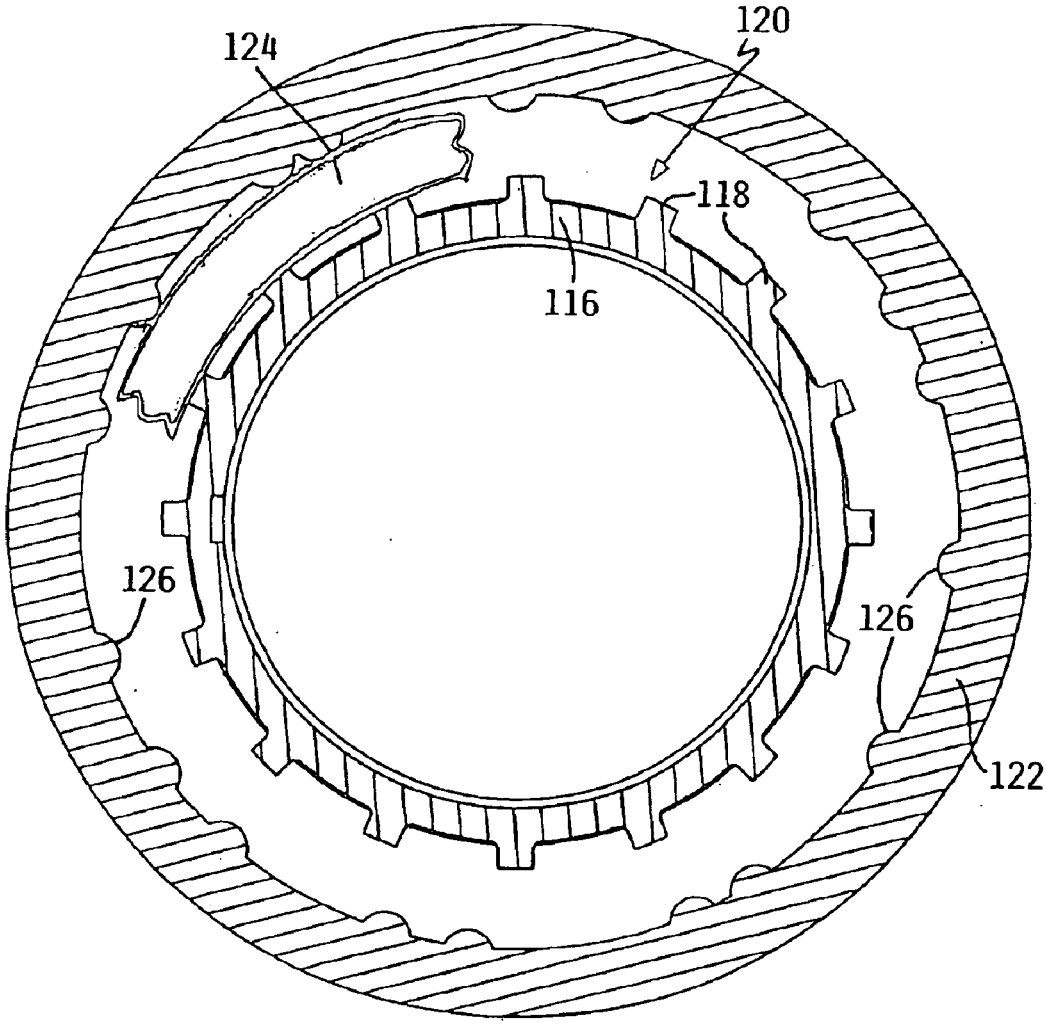
FIG. 12 is a cross-sectional view through the clutch hub on the bull gear and the trip plate illustrating the friction clutch between the bull gear and the trip plate.
Figure 11:
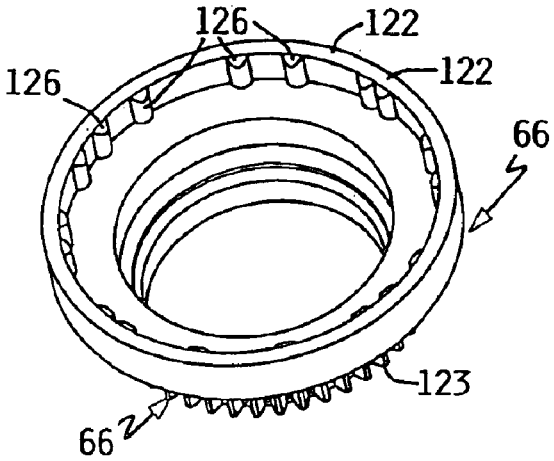
FIG. 11 is a perspective view of the bull gear shown in FIG. 8, particularly illustrating the clutch hub thereon for transferring torque to the trip plate, and thus, to the nozzle assembly.

Referring now to FIGS. 11 and 12, bull gear 66 is integrally formed with a short, cylindrically shaped clutch hub 122 extending above the teeth 123 of bull gear 66. Clutch hub 122 concentrically surrounds central hub 116 of trip plate 114. A circular, friction clutch member 124, such as an elastomeric O-ring, is sized to be pressed between clutch hub 122, and more specifically between a plurality of inwardly extending ribs 126 on clutch hub 122, and vertical drive teeth 118 on hub 116 of trip plate 114. The amount of force or pressure exerted by O-ring 124 on drive teeth 118 is chosen to provide a driving connection between bull gear 66 and trip plate 114 during normal operation of sprinkler 2. However, if a user or vandal should grab nozzle assembly 8 and manually turn nozzle assembly 8 back and forth with more force than is normally exerted by rotary drive 12, friction clutch 120 is designed to slip to allow faster rotation between nozzle assembly 8 and rotary drive 12. This prevents damage to rotary drive 12 during such periods of forced nozzle rotation.

Vertical drive teeth 118 on the hub 116 of trip plate 114 are spaced generally equally around the circumference of central hub 116. However, the radially inwardly protruding ribs 126 on the inner diameter of clutch hub 122 are not equally spaced, but instead have a non-symmetrical spacing around the inner diameter of clutch hub 122, as best shown in FIG. 12. This non-symmetrical spacing of ribs 126 helps prevent clutch member 124, i.e. the O-ring, from feeling bumpy during manual advancement of nozzle assembly 8. Thus, if a user manually rotates nozzle assembly 8 in one direction or the other, friction clutch 120 will provide a smoother feel to the user. Accordingly, the non-symmetrical spacing of ribs 126 on clutch hub 122 relative to the symmetrical drive teeth 118 on trip plate 114 is preferred over a configuration where both ribs 126 and drive teeth 118 are symmetrical relative to one another.

Friction clutch 120 has two desired operational characteristics. The first is that it provide adequate driving torque through the clutch, namely that it rotate nozzle assembly 8 without slipping during the normal operation of sprinkler 2. Sprinkler 2 shown herein nominally needs approximately 2 inch pounds of force through friction clutch 120 to be properly driven. Thus, taking manufacturing tolerances and variable environmental conditions into account, both of which can increase the force needed to drive nozzle assembly 8 from the nominal value of 2 inch pounds, friction clutch 120 is designed not to slip through approximately 3 to 4 inch pounds of force.

The second desirable characteristic of friction clutch 120 is that it provide slipping during manual advancement of nozzle assembly 8 by a user. There will be times when a user might wish to manually advance nozzle assembly 8 by overcoming friction clutch 120, such as to manually advance rotary drive 12 to a reversal point or for other reasons. Desirably, friction clutch 120 should not be so stiff as to make it very hard for a user to manually advance,nozzle assembly 8. Thus, friction clutch 120 should slip at some higher level of force. In the case of sprinkler 2 shown herein, friction clutch 120 is configured to desirably slip whenever the user applies at least approximately 6 inch pounds of force. Thus, to recapitulate, friction clutch 120 is designed not to slip below approximately 3 to 4 inch pounds of force, but to slip above approximately 6 inch pounds of force.

The Applicants originally used a dry, non-lubricated O-ring 124 and configured the interference fit on O-ring 124 provided by ribs 126 and teeth 118 to provide a friction clutch 120 that met the two characteristics set forth above. However, in testing sprinklers 2 built with a friction clutch 120 of the type disclosed herein, the Applicants found that contaminants in the water, such as oil or algae, would loosen the interference fit so much that some sprinklers 2 would no longer be properly driven. In other words, these sprinklers would slip below approximately 3 to 4 inch pounds of force.

To overcome this problem, the Applicants devised the concept of first lubricating O-ring 124 by immersing such O-ring in a lubricating oil or grease of the same general type as is used by the assignee to lubricate rotary drives in its golf sprinklers. This is a lubricating oil having a high viscosity index as shown in the following table:

| | CST | SUS |
|---|---|---|
| 100ø F | 54–58 | 234–258 |
| 210ø F | 10–11.5 | 49.7–54.9 |

Then, the interference fit on O-ring 124 provided by ribs 126 and teeth 118 w a s adjusted by tightening the fit provided by ribs 126 and teeth 118 so that the above-described two desirable operational characteristics of friction clutch 120 were still achieved, namely of not slipping below approximately 3 to 4 inch pounds of force and of slipping above approximately 6 inch pounds of force. With such a tightened interference fit built into the parts that carry ribs 126 and teeth 118, each sprinkler 2 is then built with an O-ring that has been pre-lubricated using a suitable oil or grease. The Applicants have found that such a sprinkler is thereafter relatively impervious to the effects of contaminants in the water flowing through the sprinkler such that sprinklers built with pre-lubricated O-rings are much less likely to begin to slip due to the effects of such contaminants on the driving force provided by friction clutch 120 than sprinklers built with dry, non-lubricated O-rings.

The example of the oil set forth above herein for use in pre-lubricating O-ring 124 is only one example of an oil that adequately lubricates the O-ring, which in conjunction with a properly designed interference fit as provided by ribs 126 and teeth 118, allows friction clutch 120 to more reliably resist the effects of contaminants in the water. Other specific types of lubricating oils and greases may also be found which would be suitable for pre-lubricating O-ring 124.

Full Circle Operation

Full circle ring 158 has been described above in connection with cam 156 on the underside of ring 158 that acts against pawl 150 to normally keep pawl 150 retracted within stop assembly 112. However, full circle ring 158 is so-named because it comes into play when one adjusts sprinkler 2 to water a full circle, i.e. 360ø. That operation will now be described.

Figure 14:
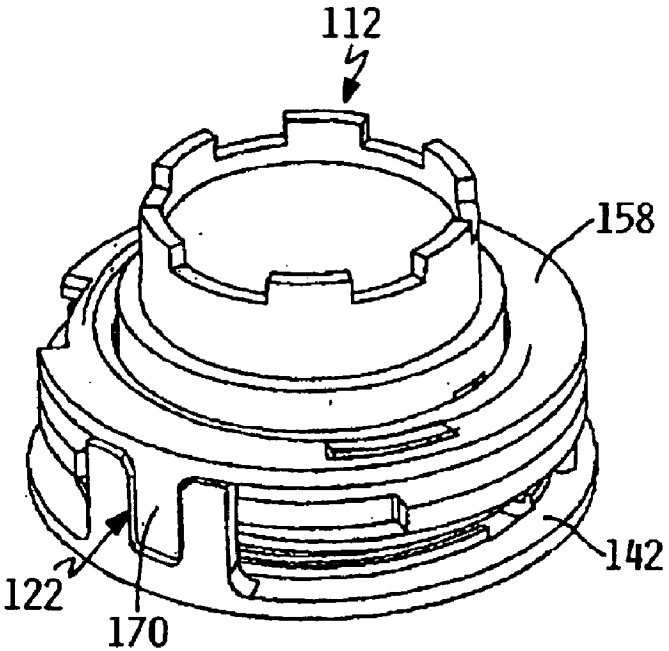
FIG. 14 is a perspective view of one side of the adjustable stop assembly shown in FIG. 8.

As shown in FIG. 14, full circle ring 158 overlies stop plate 146 and has a downwardly extending guide tab 170 received in a U-shaped guide slot 172 on base 142 of stop assembly 112. Full circle ring 158 can move vertically upwardly and downwardly relative to base 142 with guide tab 170 sliding up and down in guide slot 172. Torsion spring 162 also acts as an expansion spring with spring 162 having its lower end bearing against base 142 and its upper end bearing against the underside of stop plate 146. Thus, spring 162 is effective to move stop plate 146, and hence the overlying full circle ring 158, upwardly relative to base 142. Full circle ring 158 is moved upwardly by stop plate 146 due to various downwardly projecting spacers (not shown) bearing against stop plate 146. Such spacers keep full circle ring 158 level relative to stop plate 146 and also let stop plate 146 act on full circle ring 158 to lift full circle ring 158 as stop plate 146 rises under the influence of torsion spring 162 lifting upwardly on stop plate 146.

When sprinkler 2 is in use and is being used for part circle operation, i.e. when the arc of rotation is less than 360ø, stop plate 146 and full circle ring 158 are both forced downwardly towards base 142 to axially compress torsion spring 162 somewhat. This occurs because various downwardly extending tabs 174 (shown in FIG. 2) on the underside of an annular horizontal partition 176 at the top of drive housing 14 bear against the top of full circle ring 158 and force such full circle ring 158 and the underlying stop plate 146 downwardly against torsion spring 162. However, as stop assembly 112 is rotated during an arc adjustment operation and as it reaches its full circle or 360ø position, these tabs 174 in drive housing 14 become aligned with various cut-outs or notches 178 in full circle ring 158. At this instant, stop plate 146 and full circle ring 158 can move upwardly under the influence of the axial compression in torsion spring 162 with tabs 174 then being received in cut-outs 178 until such time as full circle ring 158 abuts against the same partition 176 that carries tabs 174.

The above-described upward movement of full circle ring 158 and stop plate 146 is selected to be enough to cause adjustable arc limit stop 100 to rise above the plane in which its corresponding trip tab 104 travels. Remember that when torsion spring 162 is axially compressed with tabs 174 pushing down on full circle ring 158, adjustable arc limit stop 100 is at the same vertical level as trip tab 104 so that trip tab 104 will hit adjustable arc limit stop 100 as it is being rotated by rotation of nozzle assembly 8. However, when tabs 174 enter cut-outs 178 in full circle ring 158, the compressed torsion spring 162 expands to lift stop plate 146 and full circle ring 158 enough to lift the free end of adjustable arc limit stop 100 above the path of travel of trip tab 104. Thus, trip tab 104 never hits adjustable arc limit stop 100 after this occurs.

If the rotary drive is toggled so that trip tab 104 is moving towards arc limit stop 100 when conversion to full circle operation occurs, then the sprinkler will keep moving in this same direction and will miss arc limit stop 100 to immediately convert to unidirectional rotation. If the rotary drive is toggled so that trip tab 104 is moving away from arc limit stop 100 when conversion to full circle operation occurs (i.e. trip tab 102 is moving towards arc limit stop 98), then the sprinkler will reverse direction once when trip tab 102 hits arc limit stop 98. Thereafter, the sprinkler will begin unidirectional rotation in the same direction as in the previous example. Accordingly, whether sprinkler 2 immediately begins unidirectional rotation or reverses direction once depending upon which way it was moving immediately prior to conversion to full circle operation, the result is that sprinkler 2 will thereafter operate in its full circle mode by rotating in a unidirectional direction completing one revolution after another without reversing or oscillating again.

This type of full circle operation is preferred over one where sprinkler 2 oscillates back and forth between 360ø because it enhances uniform watering, namely there is no strip at the 360ø mark that receives more or less water than the rest of the circle. As just noted, conversion to true full circle operation occurs in sprinkler 2 of this invention because of vertical movement of one of arc limit stops 98 and 100 out of the path of movement of its trip tab.

If part circle operation is desired, the user can rotate stop assembly 112 back out of its full circle position. As this occurs, tabs 174 on drive housing partition 176 will engage against the side of cut-outs 178. Tabs 174 can be inclined to exert a camming action to more easily permit full circle ring 158 to be forced beneath tabs 174. As soon as tabs 174 come up out of cut-outs 178 and ride on the top of full circle ring 158, full circle ring 158 and stop plate 146 have been moved down to axially compress torsion spring 162 and to lower adjustable arc limit stop 100 back down into a position where it will be engaged by its trip tab 104. Thus, normal part-circle, oscillating rotation as described above will again occur.

The Arc Indicator

Figure 20:
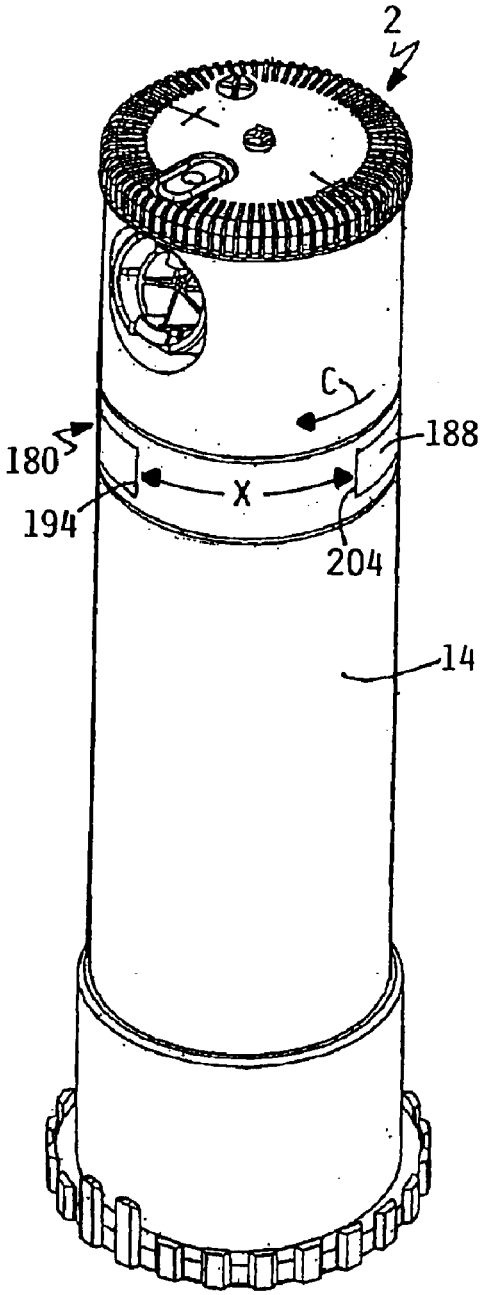
FIG. 20 is a perspective view of the exterior of the sprinkler riser of the sprinkler shown in FIG. 1, particularly illustrating the arc indicator with the arc indicator showing that the sprinkler has been adjusted to water an arc segment of 270ø.
Figure 21:
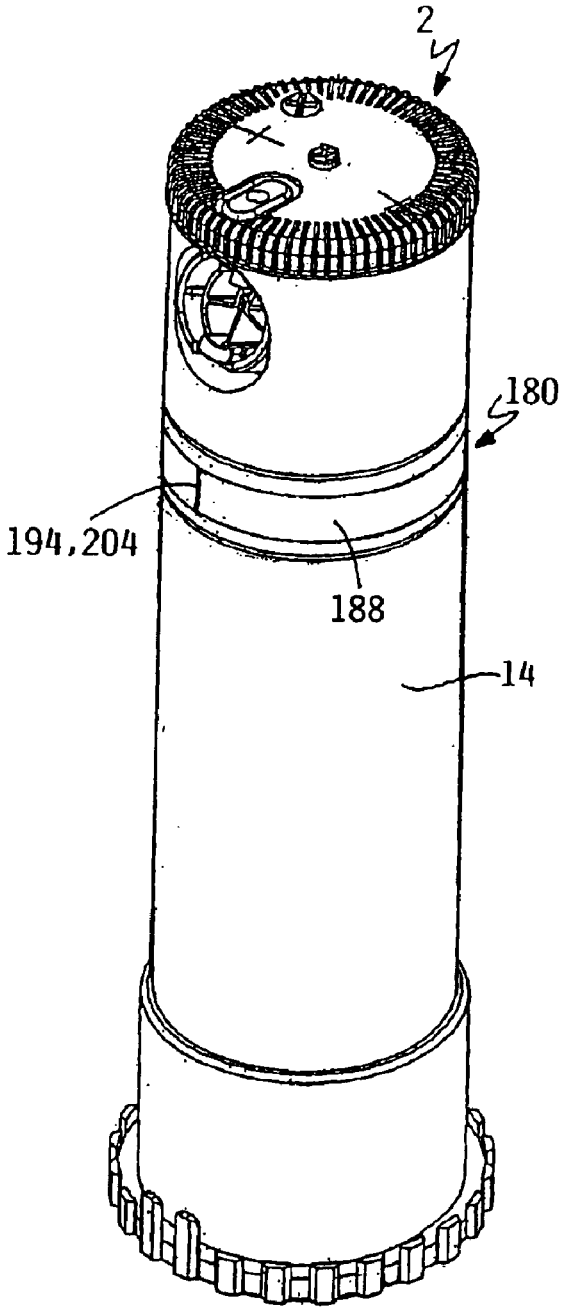
FIG. 21 is a perspective view, similar to FIG. 20, of the exterior of the sprinkler riser of the sprinkler shown in FIG. 1, particularly illustrating the arc indicator with the arc indicator showing that the sprinkler has been adjusted to full circle operation to water a circle covering 360ø.

Sprinkler 2 of this invention also includes a novel arc indicator 180 for visually indicating to the user both the extent of the arc of rotation as well as the absolute direction of the arc segment being watered. This arc indicator 180, positioned on top of drive housing 14 immediately beneath rotatable nozzle assembly 8, will now be described. The appearance of arc indicator 180 to a user observing sprinkler 2 is best illustrated in FIGS. 20, 21 and 27.

Turning to the structure of arc indicator 180, the previously described arc adjustment member 132 shown in FIG. 8 has a central hub 134 that is located above a circular opening 182 in partition 176 in drive housing 14 so as to engage stop assembly 112 carried within drive housing 14, a portion of stop assembly 112 extending upwardly through opening 182 to engage with hub 134 of arc adjustment member 132. Arc adjustment member 132 also includes a cylindrical wall 184 that is stepped or inset relative to a cylindrical rim 186 forming the upper portion of arc adjustment member 132. Cylindrical wall 184 and cylindrical rim 186 are located immediately above drive housing 14 when arc adjustment member 132 is secured to adjustable stop assembly 112. The internal ring gear 140 that is engaged by arc setting shaft 128 is located on an inner diameter of cylindrical rim 186 of arc adjustment member 132. Cylindrical wall 184 beneath rim 186 has a slightly smaller diameter than rim 186 to provide a surface against which an indicator band 188 can be gradually uncovered.

Figure 22:
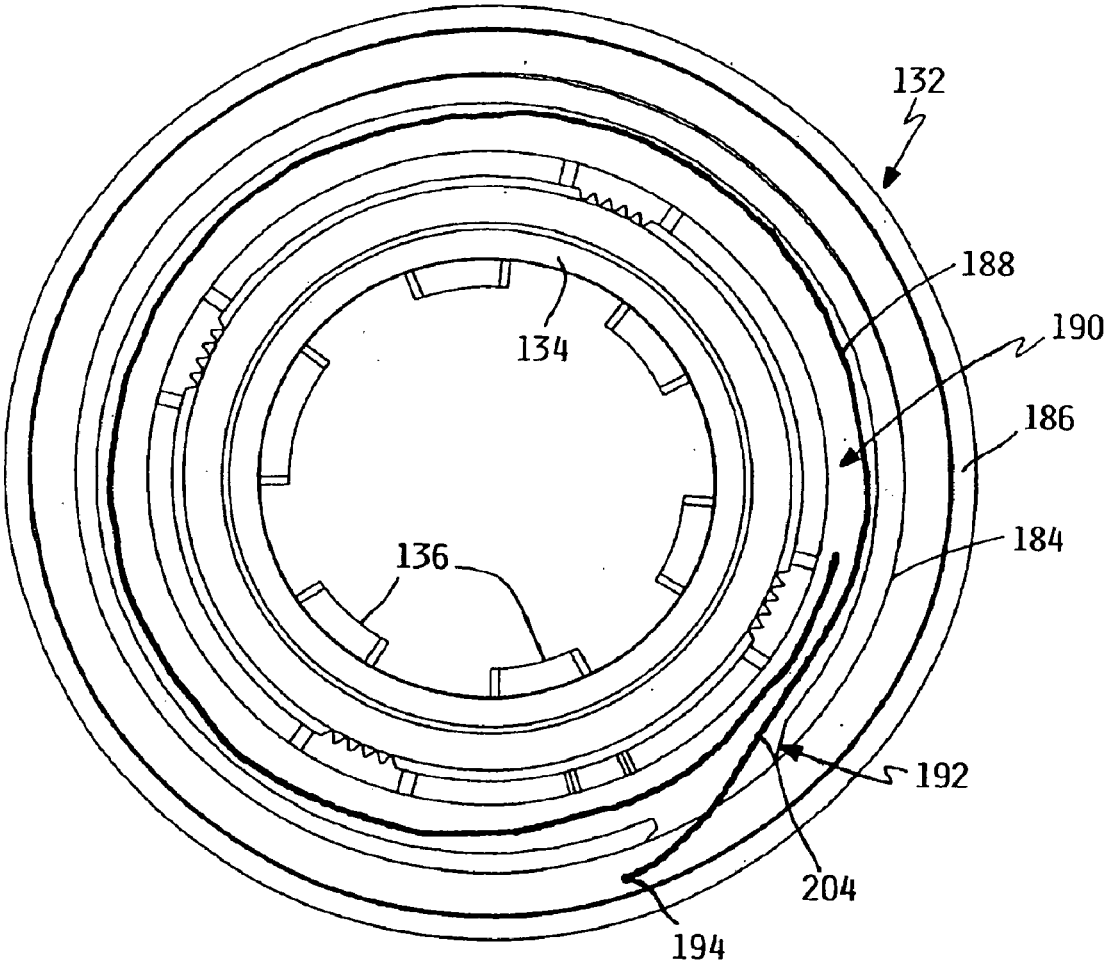
FIG. 22 is a bottom plan view of a portion of the arc indicator shown in FIG. 20, particularly illustrating the insertion of the indicator band into the arc adjustment member with the arc adjustment member being set to provide a minimum arc.
Figure 23:
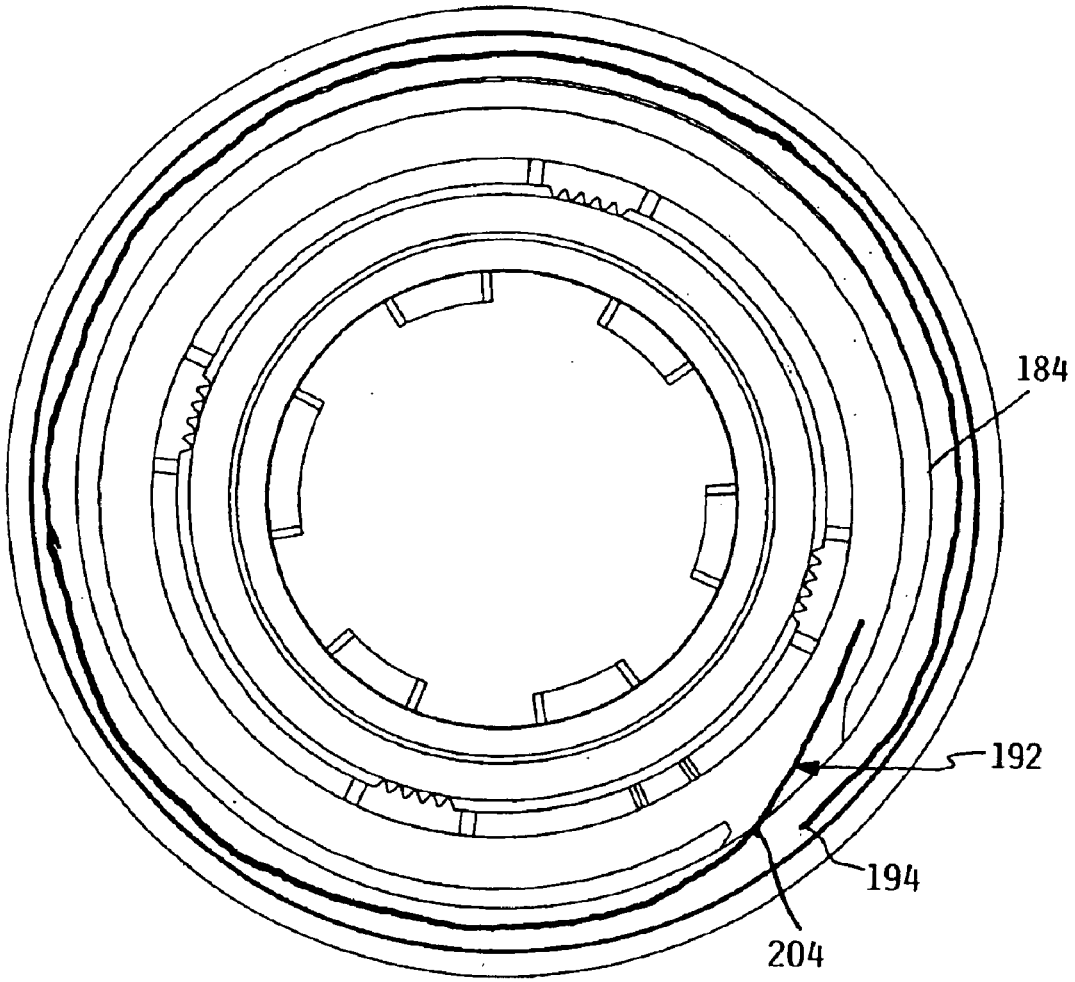
FIG. 23 is a bottom plan view, similar to FIG. 22, of a portion of the arc indicator shown in FIG. 20, particularly illustrating the insertion of the indicator band into the arc adjustment member with the arc adjustment member being set to provide a maximum arc.

Looking at the bottom of arc adjustment member 132 as shown in FIGS. 22 and 23, an interior annular channel 190 is provided adjacent the inner diameter of cylindrical wall 184. A slot 192 is provided in the peripheral cylindrical wall 184 exposing this channel 190. A flexible indicator band 188 can be placed or wound into channel 190 with one end 194 of indicator band 188 extending outwardly through slot 192 in the peripheral cylindrical wall 184 to be exposed outside of cylindrical wall 184. This protruding end 194 of indicator band 188 has a downwardly extending locking tab (not shown).

An outer transparent window 198 covers arc adjustment member 132 including cylindrical rim 186 and peripheral cylindrical wall 184. This window 198 has a notch 200 in an inwardly protruding lower shoulder 202. The locking tab on indicator band 188 is inserted into notch 200 to anchor indicator band 188 in place. Thus, when these parts are assembled, the exposed end 194 of indicator band 188 is visible through transparent window 198 against the background surface provided by peripheral cylindrical wall 184 of arc adjustment member 132.

To more easily view indicator band 188, indicator band 188 and peripheral cylindrical wall 184 of arc adjustment member 132 are provided in contrasting colors. Preferably, arc adjustment member 132 and its peripheral cylindrical wall 184 are molded out of a black plastic, while indicator band 188 can be formed from a bendable, relatively stiff plastic in a bright color other than black, such as white, red, blue, etc. Looking at FIG. 29, indicator band 188 is shown as a dark ring immediately below nozzle assembly 8 on top of drive housing 4.

As just indicated, arc indicator 180 described above is located on top of the non-rotatable drive housing 14 of riser 4 immediately below rotatable nozzle assembly 8. Like drive housing 14, arc indicator 180 does not rotate with nozzle assembly 8 but remains stationary relative to nozzle assembly 8 during normal operation of sprinkler 2. When the user adjusts or changes the arc of rotation of sprinkler 2, arc adjustment member 132 rotates relative to transparent window 198 and indicator band 188. When the arc is being increased, the rotation of arc adjustment member 132 causes indicator band 188 to be progressively uncovered such that more and more of indicator band 188 shows outside on top of peripheral cylindrical wall 184 of arc adjustment member 132. Indicator band 188 itself remains stationary due to its tabbed locking engagement with notch 200 in stationary outer window 198. Conversely, if the arc of rotation is being decreased, indicator band 188 is progressively covered as arc adjustment member 132 moves or rotates in the opposite direction.

The amount which indicator band 188 shows or is visible represents the amount of arc that has been selected by the user. For example, if the arc of rotation is set to a quarter circle or 90ø, indicator band 188 will be visible around a quarter or 90ø of peripheral cylindrical wall 184. If the user increases the arc to water a half circle or 180ø, an additional 90ø of indicator band 188 will be uncovered as arc adjustment member 132 is turned so that now indicator band 188 will be visible around a half circle or 180ø of peripheral cylindrical wall 184. The visible portion of indicator band 188 thus visually indicates to the user what the selected arc of rotation is. Thus, the user can simply glance at indicator band 188 and tell at an instant what the arc of rotation is by noting how much of indicator band 188 is visible.

Indicator band 188 can be progressively uncovered from a minimum arc of rotation provided by rotary drive 12, which is approximately 30ø, as shown in FIG. 12. Note in FIG. 22 that approximately 30ø of indicator band 188 is uncovered representing the smallest arc of rotation that can be set for sprinkler 2. In the maximum arc provided by rotary drive 12, namely full circle or 360ø operation, indicator band 188 is visible around the entire circumference of arc adjustment member 132. See FIG. 23 which shows that a full 360ø uncovering of indicator band 188 has occurred.

In addition, arc indicator 180, including indicator band 188, is entirely positioned on the non-rotary drive housing of riser 4 to itself be non-rotary during operation of sprinkler 2. No portion of arc indicator 180 is carried on rotatable nozzle assembly 8. Thus, arc indicator 180 at all times remains stationary relative to drive housing 14 and to rotary drive 12 carried in riser 4. Part of that rotary drive, as we have seen, is represented by the two arc limit stops, namely fixed arc limit stop 98 and adjustable arc limit stop 100.

This allows the visible ends of indicator band 188 to directly represent the ends of the arc of rotation such that indicator band 188 points in an absolute or non-relative manner at the arc segment of ground being watered. For example, the protruding end 194 of indicator band 188 that is always present outside peripheral cylindrical wall 184 of arc adjustment member 132 can represent the fixed side of the arc. The other visible end 204 of indicator band 188, i.e. the spot on indicator band 188 where the rest of indicator band 188 becomes covered by slot 192 in peripheral cylindrical wall 184, then represents the other or movable side of the arc. As the arc is adjusted upwardly and the movable side of the arc moves away from the fixed side, the visible length of indicator band 188 will grow, but its two visible ends 194 and 204 still represent where the arc of rotation begins and ends.

When indicator band 188 is correlated with the direction in which nozzle body 35 points as is now possible, each end of indicator band 188 can be aligned with nozzle body 35 at the moment of drive reversal. Thus, as nozzle assembly 8 rotates towards its minimum arc, nozzle body 35 will overlie the fixed visible end 194 of indicator band 188 at the moment in time when rotary drive 12 reverses. Then, as nozzle body 35 approaches the maximum arc that has been selected, nozzle body 35 will again overlie the movable visible end 204 of indicator band 188 at the moment in time when rotary drive 12 again reverses to begin moving back.

As a result, the user is informed exactly what arc of ground will be watered by looking at riser 4 when it is popped up since the orientation of the visible portion of indicator band 188 on riser 4 will indicate the absolute direction in which the watered arc of ground will be oriented. For example, if one were looking down at riser 4, if indicator band 188 extends for 90ø and is located in the upper right quadrant extending from North to East, then the arc of ground being watered will cover 90ø and will be directed to the upper right Northeast quadrant. Knowing that the orientation of indicator band 188 absolutely indicates where the arc being watered will be oriented on the ground helps the user install and properly position sprinkler 2 by adjusting riser 4 within sprinkler body 6, or by adjusting sprinkler body 6 on water fittings connecting to sprinkler body 6, until indicator band 188 points to and covers the arc segment where one wants the water to go.

In FIG. 20, arc indicator 180 indicates a sprinkler 2 that has been set for 270ø, with the fixed visible end 194 of indicator band 188 being shown on the front left side of sprinkler 2 and with the movable visible end 204 of indicator band 188 being shown on the front right side of sprinkler 2 in FIG. 20. In FIG. 20, the visible portion of indicator band begins at 194 and extends around the back of sprinkler 2 (where it cannot be seen in FIG. 20) until terminating at 204. The 270ø between the ends 194 and 204 means the sprinkler is set to water an arc of 270ø. The orientation of the visible portion of indicator band 188 on drive housing 4 shows where that 270ø pattern will go, namely in the 270ø arc segment mostly facing away from the viewer of FIG. 20. The 90ø gap between the visible ends 194 and 204 of indicator band 188, which gap is labeled as x in FIG. 20 and which most directly faces the viewer of FIG. 20, is that portion of the circumference of the sprinkler in which indicator band 188 has not been uncovered and is not visible. No water will be projected in this 90ø gap.

If the user adjusts the sprinkler 2 shown in FIG. 20 to achieve full circle or 360ø operation, then indicator band 188 will be additionally progressively uncovered with movable visible end 204 of indicator band 188 moving towards fixed visible end 194 (as shown by the arrow C in FIG. 20) to fill in the 90ø gap x in FIG. 21. When full circle operation has been set, visible ends 194 and 204 will overlie one another. In this condition, depicted in FIG. 21, indicator band 188 will be visible around the entire circumference of sprinkler 2 to indicate full circle operation.

Arc indicator 180 of this invention has many advantages over prior art indicators. No prior art indicator shows both the amount of the arc of rotation as well as absolutely indicating the arc segment of ground that will be covered by sprinkler 2 in a manner visible to someone observing the exterior of sprinkler 2 when riser 4 is popped up. The advantages of this are apparent.

In addition, no arc indicator known in sprinklers uses a band 188 whose length is related to the amount of the arc being watered. This band 188 whose visible extent can be progressively increased or decreased and whose visible extent is correlated to the arc of rotation of sprinkler 2 drive permits the user to read what the selected arc is at a glance, without having to read a pointer against a scale. Again, the advantages of this are also apparent.

While use of a band type indicator is preferred, the advantages of placing arc indicator 180 entirely on the non-rotary drive housing 14 so that it can simultaneously indicate both the amount of the arc of rotation as well absolutely indicate the direction of the arc segment of ground being watered are useful even if a more traditional pointer and scale type indicator were used in place of an indicator band 188. For example, in such an indicator, peripheral cylindrical wall 184 of arc adjustment member 132 could be provided with a pointer that could be read against a scale inscribed on the transparent window. Such a scale would still indicate the amount of the arc of rotation. In addition, the location of the scale and pointer on the side of riser 4 would still indicate where the arc being watered will point, i.e. the 0 mark on the scale indicating the fixed side of the arc while the position of the movable pointer would indicate the movable side of the arc.

Side Mounted Arc Adjustment Member

Figure 32:
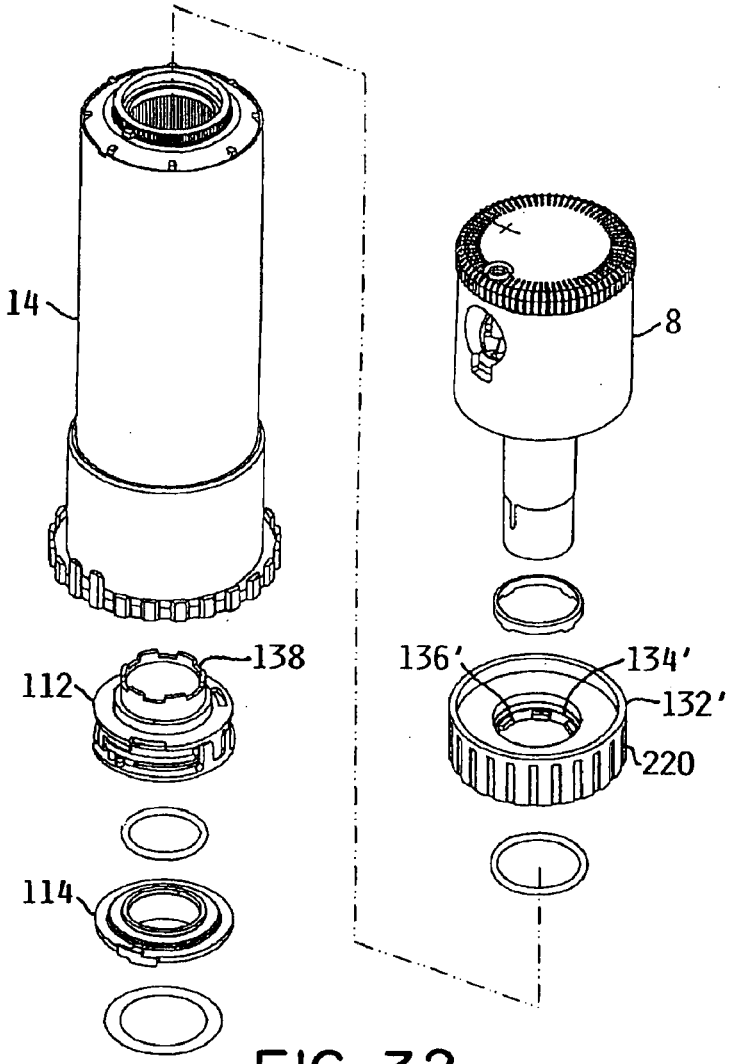
FIG. 32 is an exploded perspective view of some portions of the riser of the sprinkler shown in FIG. 32, particularly illustrating the arc adjustment member beneath the nozzle assembly on the right side of the drawing and the adjustable stop assembly and trip plate on the left side of the drawing.
Figure 31:
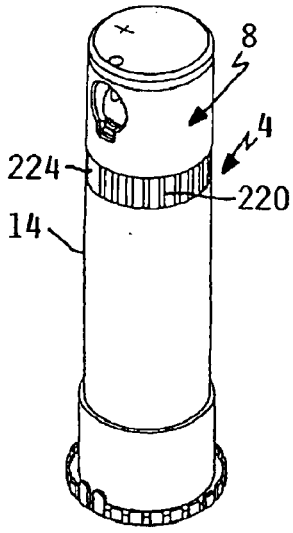
FIG. 31 is a perspective view of the sprinkler riser of the sprinkler shown in FIG. 1, particularly illustrating a second embodiment of the arc adjustment structure used to adjust the arc of rotation provided by the rotary drive.

Referring now to FIGS. 31 and 32, an alternate arc adjustment structure is depicted which adjusts from the side of sprinkler 2 rather than from the top of sprinkler 2.

In this system, an arc adjustment member 132' is provided which sits on top of drive housing 14 in the space previously occupied by indicator 180. Arc adjustment member 132' still has a central hub 134' and inwardly extending teeth 136' that mate with notches 138 in adjustable stop assembly.

However, arc adjustment member 132' is now enlarged in size so that it's cylindrical outer wall 220, which is ribbed to allow the user to more easily grip arc adjustment member 132', forms part of the exterior of sprinkler riser 4 and is of the same general diameter as riser 4. In the prior arc adjusting structure, transparent window 198 of indicator 180 was on the exterior of sprinkler riser 4, but now this window 198 and the rest of indicator 180 is gone. In addition, arc setting shaft 128, spring 129, and gear 130 and the ring gear 140 on the arc adjustment member are omitted.

With arc adjustment member 132' shown in FIGS. 31 and 32, one simply grips the outer cylindrical wall 220 of arc adjustment member 132' and directly rotates member 132' in one direction of the other to adjust the arc. A pointer on a non-ribbed portion 224 of wall 220 can be correlated with the movable side of the arc, namely with the movable arc limit stop 100, to indicate or represent where the movable side of the arc. This pointer could be read against a scale placed on drive housing 14 beneath arc adjustment member 132' where the 0 point of the scale would be correlated with the fixed side of the arc as described above. Thus, because arc adjustment member 132' is still carried on the non-rotatable drive housing 14 and does not rotate with nozzle assembly 8, this pointer/scale arrangement, when properly correlated to the direction the nozzle points when the arc limit stops are encountered, will still indicate both the amount of the arc of rotation as well as the absolute direction in which the watered arc segment will extend.

Use of arc adjustment member 132' on the side of sprinkler 2 is simple and easy to rotate and involves fewer parts than what is needed for arc adjustment member 132, namely arc setting shaft 128 and its associated parts can be deleted. However, a vandal can change the arc setting without needing a tool to access the arc adjustment member 132', which can be a disadvantage. In addition, not being able to reach and rotate arc adjustment member 132' from above means that riser 4 must be popped up out of sprinkler body 6 to get access to arc adjustment member 132', which is not true for arc adjustment member 132. Accordingly, a particular user might prefer one type of arc adjustment system over the other depending upon which characteristics of each are more or less desirable to the user.

The Indicia on the Cover

Figure 33:
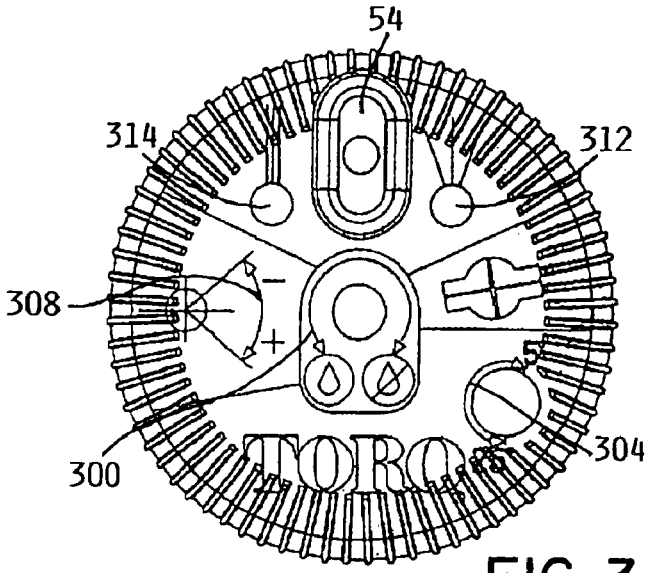
FIG. 33 is a top plan view of the rubber cover for the sprinkler riser of the sprinkler shown in FIG. 1, particularly illustrating various indicia which may be laser etched thereon.
Figure 35C:
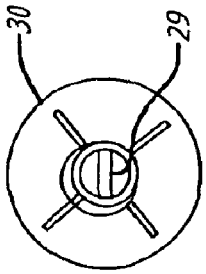
FIGS. 35A–35H are various cross-sectional and perspective views of a flow through shaft in accordance with a preferred embodiment of the present invention.
Figure 35D:
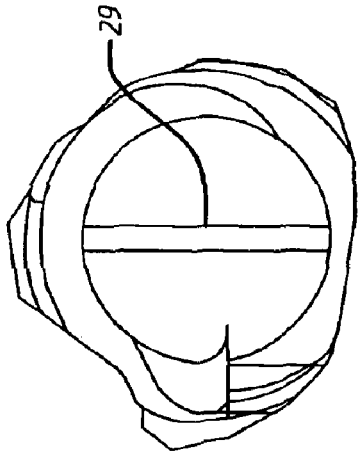
Figure 35A:
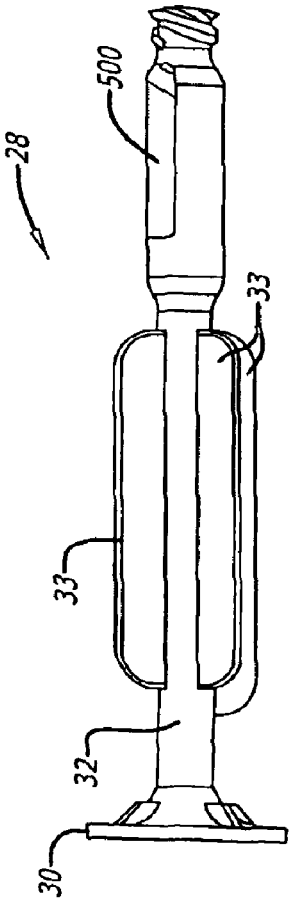
Figure 35B:
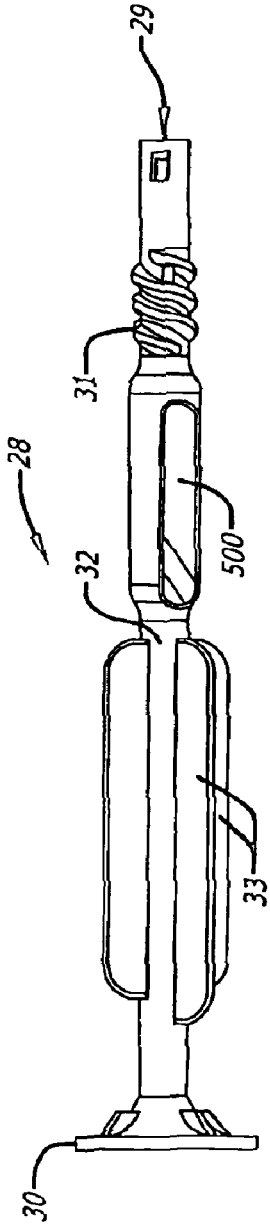
Figure 35H:
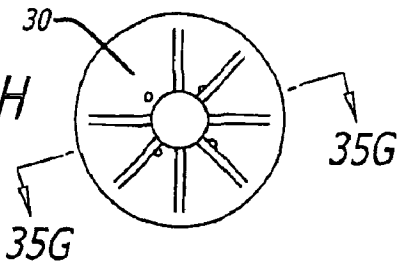
Figure 35G:
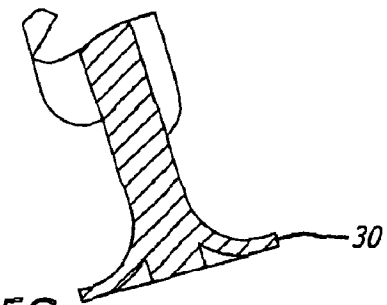
Figure 35I:
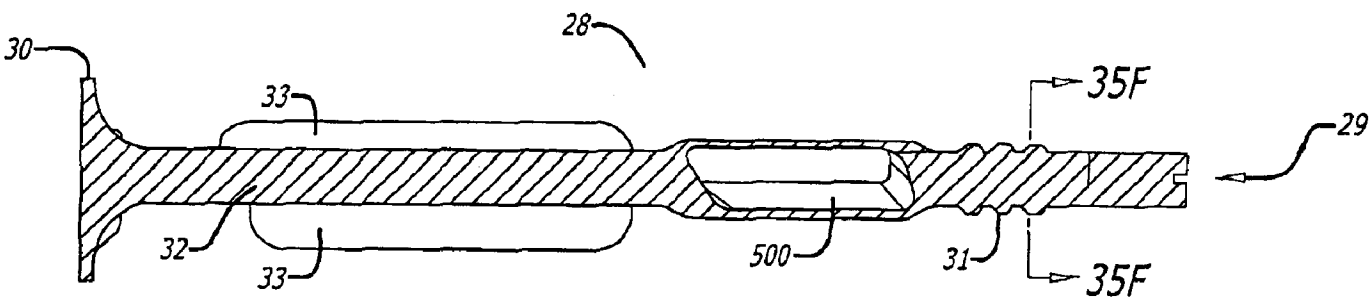
Figure 35E:
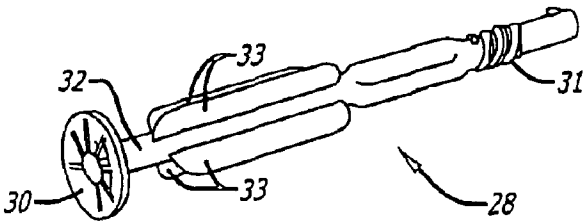
Figure 35F:
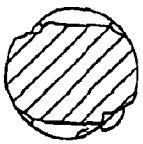

Referring now to FIG. 33, cover 22 can be provided with various indicia or markings to help the user make the various adjustments which are permitted for sprinkler 2.

A first marking 300 partially surrounds the hole in cover 22 through which top end 29 of shaft 32 of flow shut off valve 28 will protrude. Marking 300 is provided with arrows that point to water on/water off symbols to indicate the direction to turn shaft 32 to open or close, respectively, flow shut off valve 28.

A second marking 304 partially surrounds the hole in cover 22 through which the upper end of trajectory setting shaft 48 will protrude. Marking 304 is provided with arrows that point to the marked minimum and maximum trajectory angles, namely a minimum trajectory angle of 5ø and a maximum trajectory angle of 25ø. This indicates the direction to turn trajectory setting shaft 48 to increase or decrease the trajectory and also indicates what the minimum and maximum trajectory angles are, namely 5ø and 25ø.

A third marking 308 is adjacent the slit in cover 22 through which access is had to the top of arc setting shaft 128. Marking 308 is provided with arrows adjacent plus/minus symbols to indicate the direction to turn arc setting shaft 128 to increase or decrease, respectively, the arc of rotation. As noted earlier herein, the amount of the arc of rotation and the absolute direction of the arc segment being watered is indicated by indicator 180 on top of drive housing 14.

Additional markings 312 and 314 are located adjacent screw head receiving portion 54 in cover 22. Marking 312 represents a diffuse spray where the water stream exiting nozzle 10 is relatively more broken up. Marking 314 represents a tighter, less diffuse spray where the water stream exiting nozzle 10 is relatively less broken up. Rotating the head of radius adjustment screw 42, which screw head is carried on top of screw head receiving portion 54, towards marking 312 will lower radius adjustment screw 42 relative to nozzle 10 to cause a more diffuse spray. Conversely, rotating the head of radius adjustment screw 42, which screw head is carried on top of screw head receiving portion 54, towards marking 314 will raise radius adjustment screw 42 relative to nozzle 10 to cause a more diffuse spray.

The Applicants have found that such markings 300, 304, 308, 312 and 314 can be provided by laser etching such markings on rubber cover 22 using a generally conventional laser etching process, which process has not previously been used to etch markings on sprinklers or parts thereof. Use of a laser etching process for these sprinkler markings has been found desirable as it provides a very vibrant and easily seen marking.

Sprinkler 2 can obviously be built with less than all the adjustments described herein. For example, a version of sprinkler 2 could be built in which the trajectory adjusting structure is omitted such that nozzle 10 throws a water stream at a fixed angle of trajectory. Alternatively, flow shut off valve 28 could be omitted. If this occurs, the relevant markings would be omitted from cover 22 as well.

The Rebar Attachment Collar

Sprinklers 2 of the type disclosed herein are sometimes used in installations where the sprinklers are not buried in the ground, but are used above ground. In this case, the standpipe to which sprinkler body 6 is secured will hold sprinkler 2 up above the ground, but sprinkler 2 will still lean to one side of the other. Thus, stakes or posts, commonly formed out of rebar, are pushed into the ground adjacent such an above ground mounted sprinkler 2. Sprinkler 2 is tied to this rebar support stake to prevent it from leaning over too much and to keep it generally upright. The need to tie sprinkler 2 to such a rebar is an obvious disadvantage of prior art sprinklers.

Figure 34:
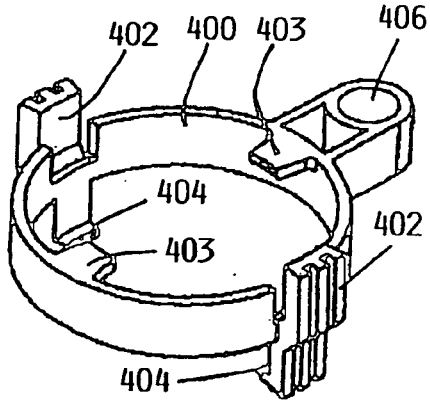
FIG. 34 is a perspective view of a rebar attachment collar that may be secured to the sprinkler shown in FIG. 1 to allow a rebar support stake or the like to support the sprinkler against leaning when the sprinkler is used in an above ground installation.

FIG. 34 illustrates a collar 400 that may be removably attached to sprinkler 2. Collar 400 is sized to have a diameter that closely fits around cap 5 on sprinkler 2. Collar 400 has resilient latching fingers 402 that carry latching tabs 404 that normally engage beneath the lower rim of cap 5. In addition, collar 400 has flat, upper tabs 403 that rest on top of cap 5 when latching tabs 404 are engaged beneath the lower rim of cap 5.

To install collar 400, collar 400 is simply pushed down onto cap 5 with fingers 402 deflecting outwardly until latching tab 404 on each finger 402 passes beneath the lower rim of cap 5. At that point, the resilient nature of fingers 402 causes latching tabs 404 to snap underneath the lower rim of cap 5 to hold collar 400 in place on cap 5. The user can manually remove collar 400 if so desired simply by pressing inwardly on the tops of latching fingers 402, thus flexing fingers 402 enough to cause latching tabs 404 to be moved out sufficiently to clear cap 5. Collar 400 can then be pulled upwardly off cap 5.

Collar 400 includes a vertically extending opening 406 that is spaced to one side of collar 400. Opening 406 is sized to allow a rebar support stake or the like to pass therethrough. Thus, if collar 400 is secured to the cap 5 of a sprinkler 2 that is to be used in an above ground installation, a rebar support stake or the like can easily pass through opening 406 on collar 400 to prevent sprinkler 2 from leaning too much, without having to manually tie sprinkler 2 to such a support stake. Collar 400 would be used principally on sprinklers 2 placed into above ground installations.

Alternate Embodiment of the Flow Shut Off Valve

Referring to FIGS. 35–39, a flow shut off valve 28 of a sprinkler 2 in accordance with an alternate embodiment of the present invention is disclosed as having a cylindrically shaped shaft 32, a disc shaped valve member 30 extending from the distal end of the shaft 32 and a threaded section 31 located near the proximal end of the shaft 32. Fluid flow through the water supply tube 26 and nozzle 35 of the sprinkler 2 is controlled to a certain extent by the valve member 30. As further described below, the amount of separation between the end of the water supply tube 26 and the valve member 30 determines the rate of fluid flow through the sprinkler 2.

Figure 36:
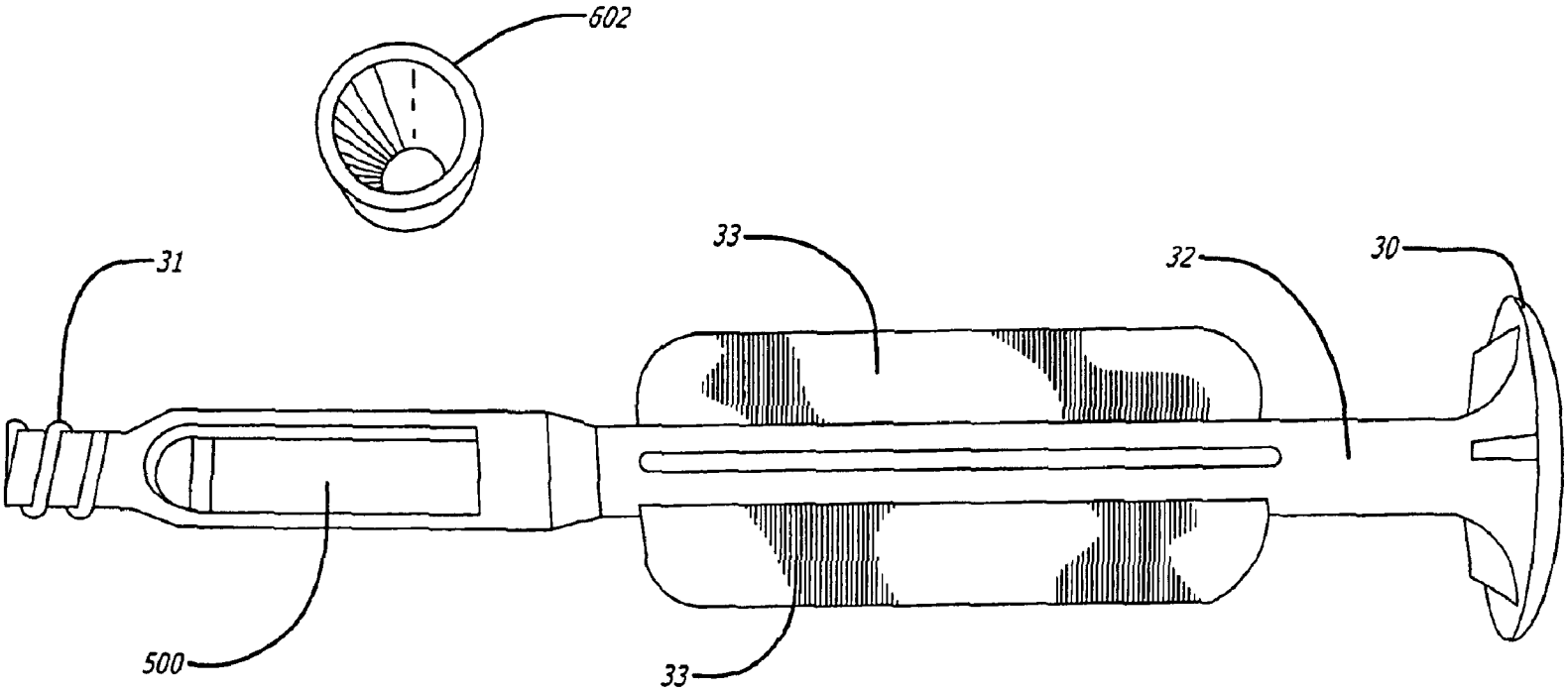
FIG. 36 is a top plan view of a flow through shaft and an arc adjustment guide in accordance with a preferred embodiment of the present invention.
Figure 37:
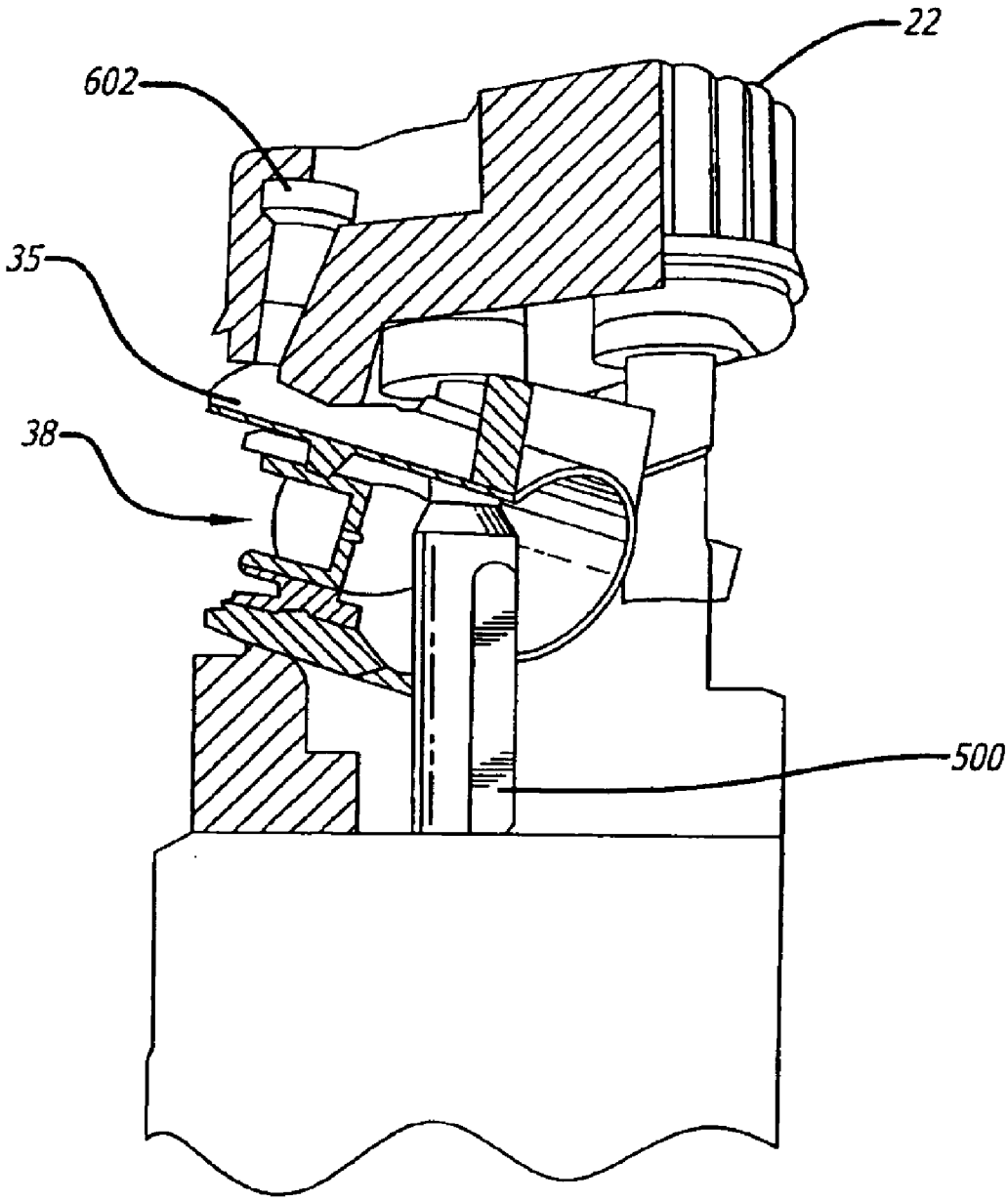
FIG. 37 is a front cross-sectional view of a rotary sprinkler in accordance with a preferred embodiment of the present invention.
Figure 38:
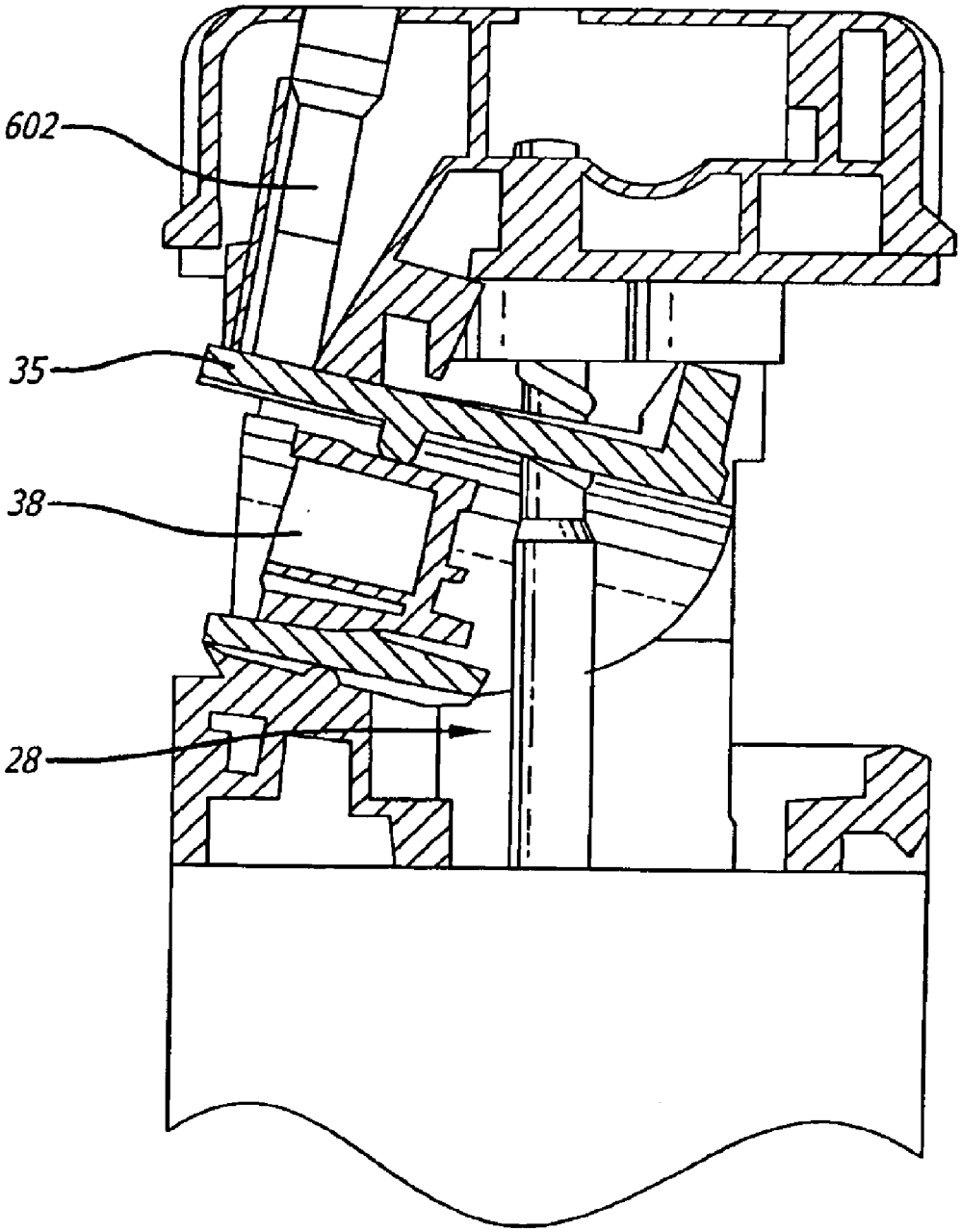
FIG. 38 is a front cross-sectional view of a rotary sprinkler in accordance with a preferred embodiment of the present invention.
Figure 39:
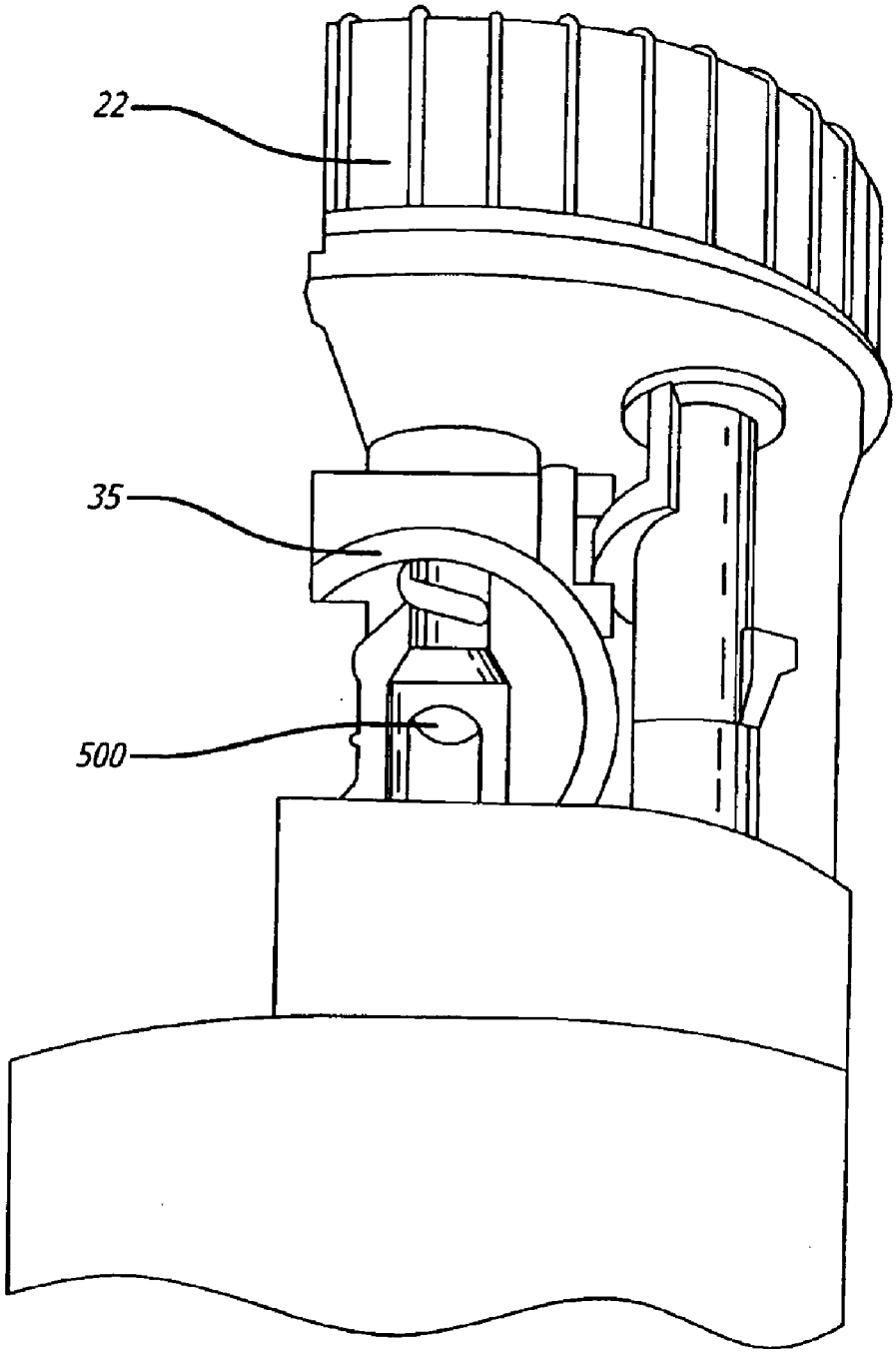
FIG. 39 is a front, partial cross-sectional view of a rotary sprinkler in accordance with a preferred embodiment of the present invention.
Figure 40C:
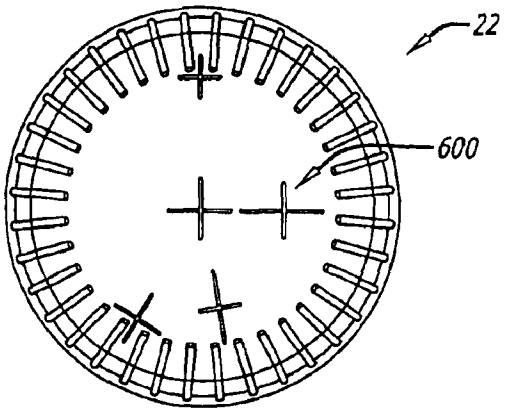
FIGS. 40A–40G are various front and cross-sectional views of a cover of a rotary sprinkler in accordance with a preferred embodiment of the present invention.
Figure 40B:
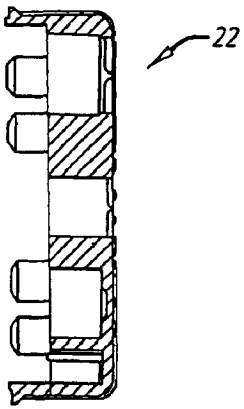
Figure 40A:
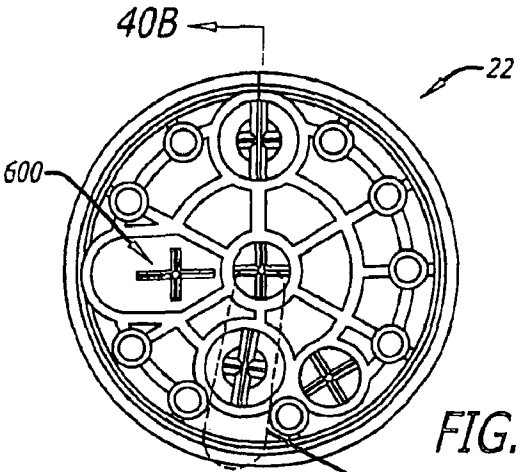
Figure 40E:
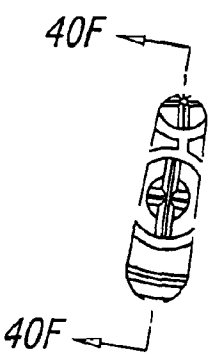
Figure 40D:
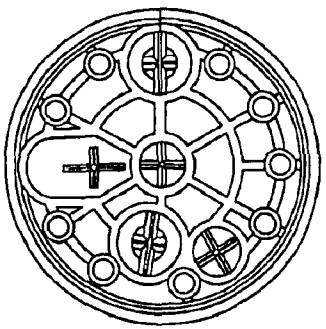
Figure 40G:
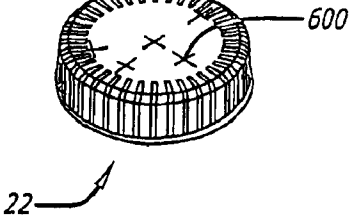
Figure 40F:
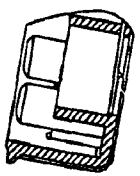

A plurality of stream straightening vanes 33 is also provided on the shaft 32 in close proximity to the valve member 30. These vanes 33 help guide the shaft 32 up and down the water supply tube 26. Also, the vanes 33 reduce water turbulence passing through the water supply tube 26. The vanes are generally planar members extending from the shaft 32 of the flow shut off valve 28. According to one exemplary embodiment, the vanes 33 are generally rectangular in shape with rounded corners as shown in FIGS. 35 and 36. Also, the embodiment depicted in FIG. 35 shows one vane 33 that is longer in length as compared to the other vanes 33 provided on the shaft 32 of the flow shut off valve 28. In a preferred embodiment, however, the vanes 33 provided on the flow shut off valve 28 are generally the same size and length. In yet another exemplary embodiment, each vane 33 may be differently sized and of varying length. In another exemplary embodiment, the edge of one or more vanes 33 may include one or more notches (not shown).

Continuing with reference to FIGS. 35–39, an opening 29 situated on top of the shaft 32 allows a tool, such as a screwdriver (not shown), to be used to rotate the shaft 32. When the valve shaft 32 is rotated, the threaded section 31 of the shaft 32 engages a seat (not shown) and causes axial movement of the shaft 32. This, in turn, causes the valve member 31 to move either up or down depending on the direction of rotation of the flow shut off valve 28. As a result, when the valve member 30 is down and away from the water supply tube 26, water may enter and pass through the water supply tube 26 and into the nozzle 35. Similarly, when the valve member 30 is up and engages the end of the tube 26, water is prevented from entering the tube 26 and flowing through the nozzle 35.

Situated between the vanes 33 and threaded section 31 of the shaft 32 is an aperture 500 that extends through the diameter of the valve shaft 32. When the flow shut off valve 28 is installed on the sprinkler 2, the aperture 500 on the shaft 32 is aligned in close proximity to the nozzle 35 and in the direction of fluid flow through the water supply tube 26 of the sprinkler 2. In this configuration, the aperture 500 acts as a stream-straightening feature that also reduces turbulence in the flow passing through the water supply tube 26. In particular, as water passes through the conduit of the water supply tube 26 and into nozzle 35, its flow is guided around the shaft 32 and through the aperture 500 which then directs the flow into the nozzle 35.

Additionally, as shown in FIG. 35, the top and bottom walls of the aperture 500 can be angled to promote better flow through the aperture 500 into the nozzle 35. That is, the top and bottom walls of the aperture 500 are not perpendicular to the longitudinal axis of the shaft 32. Rather, the top and bottom walls of the aperture may be angled (from more than 0° from perpendicular to less than 90°) so that the bore of the aperture 500 and the bore of the nozzle member 36 are substantially aligned in order to minimize turbulent water flow. According to one exemplary embodiment, the top and bottom walls of the aperture 500 are angled upwards in order to direct the flow optimally toward the nozzle. In yet another exemplary embodiment, the top and bottom walls of the aperture 500 are substantially perpendicular to the longitudinal axis of the shaft 32. In another exemplary embodiment, the top and bottom walls of the aperture 500 are substantially parallel. In another exemplary embodiment, the top and bottom walls of the aperture 500 are in skewed relation.

Turning to FIG. 36, the diameter of the valve shaft 32 is enlarged along the length of the aperture 500 to accommodate a preferred aperture size. In general, aperture size is determined by the desired fluid flow characteristics of the sprinkler 2. The increased diameter of the shaft 32 also provides sufficient material strength around the aperture 500 and, thereby, maintains the structural integrity of the shaft 32 to withstand the various flow forces passing through and around the aperture 500 during sprinkler operation.

Alternate Embodiment of Radius Adjustments Screw

In the previously described embodiment, the nozzle 35 of the sprinkler 2 includes an opening 40 into which the lower end of a radius adjustment screw 42 is threaded. Threading the radius adjustment screw 42 up or down in the opening 40 on the nozzle 35 causes the lower end of the radius adjustment screw 42 to move into or out of the stream of water exiting from the nozzle outlet 38. This in turn causes the radius of the stream to shorten or lengthen, respectively, due to stream break-up. In this configuration of the sprinkler 2, the top of the radius adjustment screw 42 is always visible and retained above the flexible rubber cover 22 of the nozzle 35.

In an alternate embodiment of the invention, shown in FIG. 40, the flexible rubber cover 22 includes one or more slits 600 that, initially, may be in alignment with the screw 42. This configuration of the cover 22 further protects the various seals and openings in the retainer plate 21 of the nozzle housing 16 from debris and damage since the slit 600 remains in a closed state until a tool or other device is inserted therethrough. As such, a tool may be inserted through the slit 600 to contact and rotate the radius adjustment screw 42, thereby adjusting the radius of the stream exiting from the nozzle outlet 38. However, because the radius adjustment screw 42 is carried on a pivotal nozzle 35 that swings or tilts relative to the cover 22, the screw head does not necessarily remain aligned with the access hole or slit 600 in the cover 22, thereby making it difficult for a user to locate the screw head. As a result, a guide 602 is provided to direct or funnel the tool into contact with the screw 42.

Figure 42:
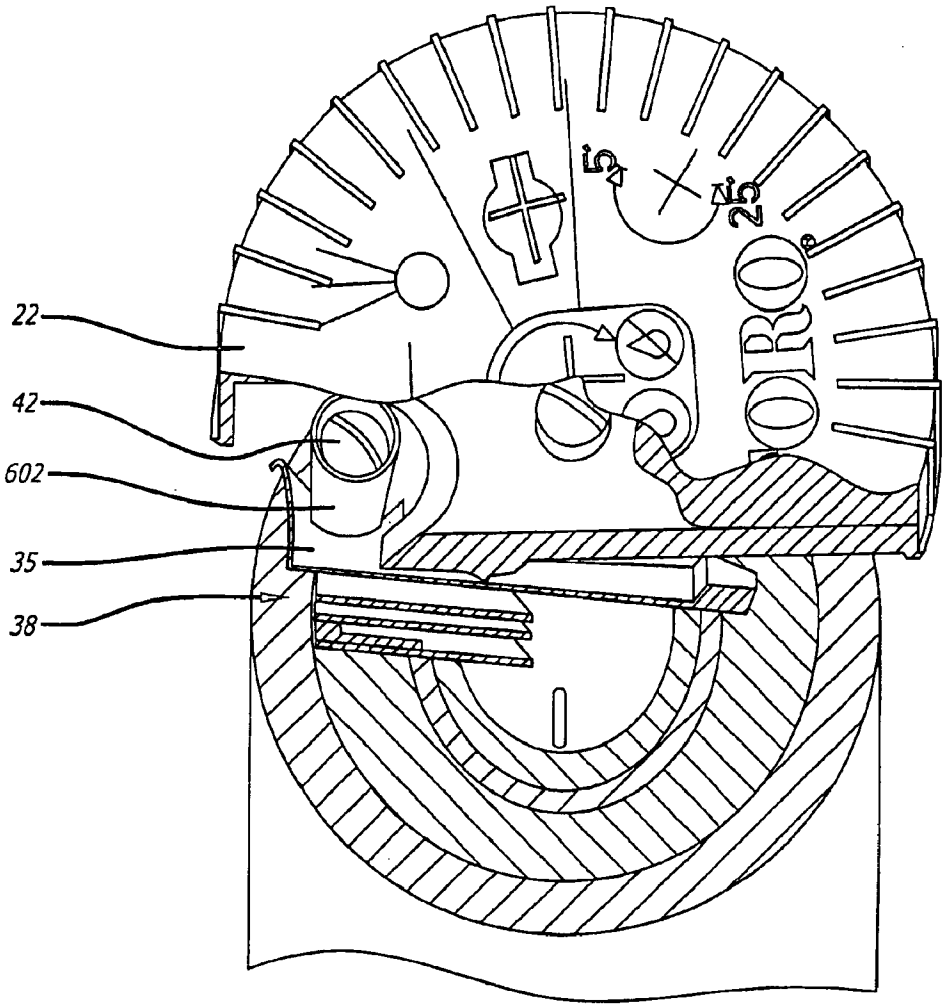

As shown in FIGS. 36, 41 and 42, the guide 602 includes a generally tubular body 604 having a small hole or opening 606 in the base of the guide 602 and a larger, funnel-shaped opening 608 at the top portion of the guide 602. In general, the hole 606 in the base of the guide 602 is sized to accommodate the shank diameter of the screw 42. When assembled, the shank or body of the radius adjustment screw 42 extends through the hole 606, with the head of the screw 42 being retained within the inner hollow cavity of the guide 602.

To adjust the radius of the water stream exiting the sprinkler nozzle 35, a tool (e.g., screwdriver) is inserted through the slit 600 in the rubber cover 22 and into the top opening 608 of the guide 602. The guide 602 is easily accessible with the tool, regardless of the degree of nozzle pivot, tilt or swing relative to the cover 22, due to its large opening 608. As the tool is advanced further within the guide 602, the funnel shaped opening 608 of the guide 602 directs the tool into the narrowed, tubular body 604 of the guide 602 and finally into contact with the screw head. Once the tool contacts the screw head, the screw 42 can be rotated either further into or out of the stream of water exiting the nozzle 35, depending on the desired stream radius. As such, this embodiment of the invention allows a user to blindly, yet accurately, access the radius adjustment screw 42. In addition, this embodiment of the rubber cover 22 further reduces the potential of debris entering the sprinkler head.

DESCRIPTION OF PREFERRED EMBODIMENTS

This Detailed Description sets forth various preferred embodiments for various aspects of a rotary sprinkler 2 of the type shown herein. However, embodiments other than those illustrated herein fall within this invention. For example, the arc indicators illustrated herein can be used in sprinklers 2 having reversible drives of other types, such as reversible ball or shiftable stator drives. Thus, various modifications of this invention will be apparent to those skilled in the art. Accordingly, the invention is to be limited only by the appended claims.

What is claimed:

1. A rotary sprinkler, comprising:
(a) a drive housing including a drive mechanism for providing rotation;
(b) a rotary nozzle assembly carried on the drive housing and rotatively coupled to the drive mechanism, the rotary nozzle assembly including a water supply tube in fluid communication with the rotary nozzle assembly; and
(c) a flow shut off valve having at least a portion thereof extending into and through the water supply tube, wherein the flow shut off valve comprises a shaft having a valve positioned on a distal end of the shaft and a threaded section adjacent to the proximal end of the shaft; an aperture positioned below the threaded section, wherein the aperture extends through the shaft; and one or more vanes extending from the shaft, wherein the one or more vanes are positioned between the aperture and the valve.

2. The rotary sprinkler of claim 1 further comprising a flexible top cover carried on a top of the rotary nozzle assembly.

3. The rotary sprinkler of claim 2 wherein the flexible top cover comprises a plurality of access slits that correspond to a plurality of adjustment members for the sprinkler, and at least one guide body positioned between the access slits and the adjustment members.

4. The rotary sprinkler of claim 3 wherein the guide body comprises a generally tubular body having an open top and a base having an opening, wherein a diameter of the open top is larger than a diameter of the opening in the base.

5. The rotary sprinkler of claim 4 wherein the open top of guide body is funnel-shaped.

6. A flow shut off valve for a rotary sprinkler, comprising:
a shaft having a valve positioned on a distal end of the shaft and a threaded section adjacent to the proximal end of the shaft;
an aperture positioned below the threaded section, wherein the aperture extends through the shaft; and
one or more vanes extending from the shaft, wherein the one or more vanes are positioned between the aperture and the valve.

7. The flow shut off valve of claim 6 wherein a top wall and a bottom wall of the aperture are angled to minimize turbulent water flow through the aperture.

8. The flow shut off valve of claim 7 wherein the top wall and the bottom wall of the aperture are angled towards the proximal end of the shaft.

9. The flow shut off valve of clam 7 wherein the top wall and the bottom wall of the aperture are substantially parallel.

10. The flow shut off valve of claim 7 wherein the top wall and the bottom wall of the aperture are in skewed relation.

11. The flow shut off valve of claim 7 wherein one or more vanes include tapered corners.

12. A rotary sprinkler, comprising:
(a) a drive housing including a drive mechanism for providing rotation;
(b) a rotary nozzle assembly carried on the drive housing and rotatively coupled to the drive mechanism, the rotary nozzle assembly including a water supply tube in fluid communication with the rotary nozzle assembly; and
(c) various adjustments provided in the drive mechanism and the rotary nozzle assembly for varying operation characteristics of at least one of the drive mechanism and the rotary nozzle assembly, the various adjustments being operable from a top of the rotary nozzle assembly through a top cover, wherein the top cover comprises a plurality of access slits corresponding to the various adjustments, and at least one guide body positioned between the access slits and the various adjustments.

13. The rotary sprinkler of claim 12 wherein the top cover is made of rubber.

14. The rotary sprinkler of claim 13 wherein the guide body comprises a generally tubular body having an open top and a base having an opening, wherein a diameter of the open top is larger than a diameter of the opening in the base.

15. The rotary sprinkler of claim 14 wherein the open top of the guide body is funnel-shaped.

16. A rotary sprinkler, comprising:
(a) a drive housing including a drive mechanism for providing rotation;
(b) a rotary nozzle assembly carried on the drive housing and rotatively coupled to the drive mechanism, the rotary nozzle assembly including a water supply tube in fluid communication with the rotary nozzle assembly;
(c) a flow shut off valve having at least a portion thereof extending into and through the water supply tube, wherein the flow shut off valve comprises a shaft having a valve positioned on a distal end of the shaft and a threaded section adjacent to the proximal end of the shaft; an aperture positioned below the threaded section, wherein the aperture extends through the shaft; and one or more vanes extending from the shaft, wherein the one or more vanes are positioned between the aperture and the valve; and (d) various adjustments provided in the drive mechanism and the rotary nozzle assembly for varying operation characteristics of at least one of the drive mechanism and the rotary nozzle assembly, the various adjustments being operable from a top of the rotary nozzle assembly through a top cover, wherein the top cover comprises a plurality of access slits corresponding to the various adjustments, and at least one guide body positioned between the access slits and the various adjustments.

17. The rotary sprinkler of claim 16 wherein a top wall and a bottom wall of the aperture are angled to minimize turbulent water flow through the aperture.

18. The rotary sprinkler of claim 17 wherein the top wall and the bottom wall of the aperture are angled towards the proximal end of the shaft.

19. The rotary sprinkler of clam 17 wherein the top wall and the bottom wall of the aperture are substantially parallel.

20. The rotary sprinkler of claim 17 wherein the top wall and the bottom wall of the aperture are in skewed relation.

21. The rotary sprinkler of claim 17 wherein one or more vanes include tapered corners.

22. The rotary sprinkler of claim 21 wherein one or more vanes have different lengths.

23. The rotary sprinkler of claim 22 wherein an edge of one or more vanes includes one or more notches.

24. The rotary sprinkler of claim 23 wherein the top cover is made of an elastomeric material.

25. The rotary sprinkler of claim 24 wherein the guide body comprises a generally tubular body having an open top and a base having an opening, wherein a diameter of the open top is larger than a diameter of the opening in the base.

26. The rotary sprinkler of claim 25 wherein the open top of the guide body is funnel-shape.

* * * * *